US010531782B2

(12) United States Patent
Park et al.

(10) Patent No.: US 10,531,782 B2
(45) Date of Patent: Jan. 14, 2020

(54) LOCK AND HOME APPLIANCE HAVING THE SAME

(71) Applicant: LG Electronics Inc., Seoul (KR)

(72) Inventors: Jinhong Park, Seoul (KR); Kichul Cho, Seoul (KR); Jinhong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/402,388

(22) Filed: May 3, 2019

(65) Prior Publication Data

US 2019/0254497 A1 Aug. 22, 2019

Related U.S. Application Data

(62) Division of application No. 15/465,010, filed on Mar. 21, 2017, now Pat. No. 10,321,798.

(30) Foreign Application Priority Data

Mar. 28, 2016 (KR) ..... 10-2016-0037154
Jul. 5, 2016 (KR) ..... 10-2016-0084695
Jan. 4, 2017 (KR) ..... 10-2017-0001232

(51) Int. Cl.
*A47L 15/42* (2006.01)
*E05C 1/12* (2006.01)
(Continued)

(52) U.S. Cl.
CPC ..... *A47L 15/4259* (2013.01); *A47L 15/4257* (2013.01); *E05C 1/12* (2013.01);
(Continued)

(58) Field of Classification Search
CPC ..... A47L 15/4259; A47L 2501/22; A47L 15/4257; A47L 15/4263; D06F 37/42;
(Continued)

(56) References Cited

U.S. PATENT DOCUMENTS 6,761,381 B2 7/2004 Prada ..... A47L 15/4259 292/109
7,775,565 B2 8/2010 Hartmann ..... A47L 15/4259 292/216
(Continued)

FOREIGN PATENT DOCUMENTS

CN 101163436 A 4/2008
CN 202450882 U 9/2012
(Continued)

*Primary Examiner* — Hiwot E Tefera
(74) *Attorney, Agent, or Firm* — Dentons US LLP

(57) ABSTRACT

A lock and a home appliance having the same are disclosed. The lock includes a holder provided at one selected from between the cabinet and the door, a housing provided at the other selected from between the cabinet and the door, a first stopper provided at the housing, a fastening unit separably coupled to the first stopper so as to be coupled to the holder when separated from the first stopper, an actuation unit configured to reciprocate in the housing, the actuation unit being configured to be moved away from the introduction port in the state of contacting the holder when the door is moved so as to close the introduction port, the actuation unit being configured to separate the fastening unit from the first stopper while being moved away from the introduction port, a first elastic member for providing force necessary to move the fastening unit away from the introduction port when the fastening unit is separated from the first stopper, a second elastic member for providing force necessary to move the actuation unit toward the introduction port, and an actuation unit lock for fixing the actuation unit to the housing when not in contact with the door and releasing coupling between the actuation unit and the housing when in contact with the door.

13 Claims, 13 Drawing Sheets

(51) Int. Cl.
*E05C 3/12* (2006.01)
*D06F 37/42* (2006.01)

(52) U.S. Cl.
CPC ..... *E05C 3/12* (2013.01); *A47L 15/4263* (2013.01); *D06F 37/42* (2013.01)

(58) Field of Classification Search
CPC . D06F 39/14; E05C 19/02; E05C 3/12; E05C 1/004; E05C 1/12; E05C 3/22; E05C 1/08; E05C 3/24; E05B 15/101; E05B 47/0603; E05B 63/20; E05B 65/0014; E05B 17/0025; Y10T 292/1043; Y10T 292/08; Y10T 292/0867; Y10T 292/558; Y10T 292/1047; Y10T 70/554; Y10T 292/0911; Y10S 292/04; Y10S 292/11; Y10S 292/69
See application file for complete search history.

(56) References Cited

U.S. PATENT DOCUMENTS

| | | | | |
|---|---|---|---|---|
| 9,924,850 | B2 | 3/2018 | Park | E05C 19/02 |
| 2002/0180319 | A1 | 12/2002 | Irwin et al. | |
| 2006/0186677 | A1 | 8/2006 | Bella | E05B 77/06 292/304 |
| 2007/0209411 | A1 | 9/2007 | Lim et al. | |
| 2009/0009043 | A1 | 1/2009 | Gwak | |
| 2012/0312594 | A1 | 12/2012 | Hapke | D06F 37/42 174/668 |
| 2013/0169138 | A1 | 7/2013 | Im et al. | |
| 2013/0234578 | A1 | 9/2013 | Ala | A47L 15/4259 312/326 |
| 2014/0077671 | A1 | 3/2014 | Dirnberger | A47L 15/4246 312/228 |
| 2015/0021927 | A1 | 1/2015 | Wang | A47L 15/4259 292/99 |
| 2015/0267446 | A1 | 9/2015 | Promutico | A47L 15/4259 292/122 |
| 2016/0029872 | A1 | 2/2016 | Kim | A47L 15/4225 312/228 |
| 2016/0251883 | A1 | 9/2016 | Wang | A47L 15/4259 292/179 |
| 2017/0188785 | A1 | 7/2017 | Park | E05C 19/02 |
| 2018/0368652 | A1 | 12/2018 | Krieger | E05C 19/02 |

FOREIGN PATENT DOCUMENTS

| | | | | |
|---|---|---|---|---|
| EP | 1 498 796 | A1 | 1/2005 | |
| EP | 1498796 | A1 | 1/2005 | |
| EP | 2450510 | A2 | 5/2012 | A47L 15/4259 |
| KR | 10-2014-0120883 | A | 10/2014 | |
| WO | 2011/126270 | A1 | 10/2011 | |

【Figure 1】
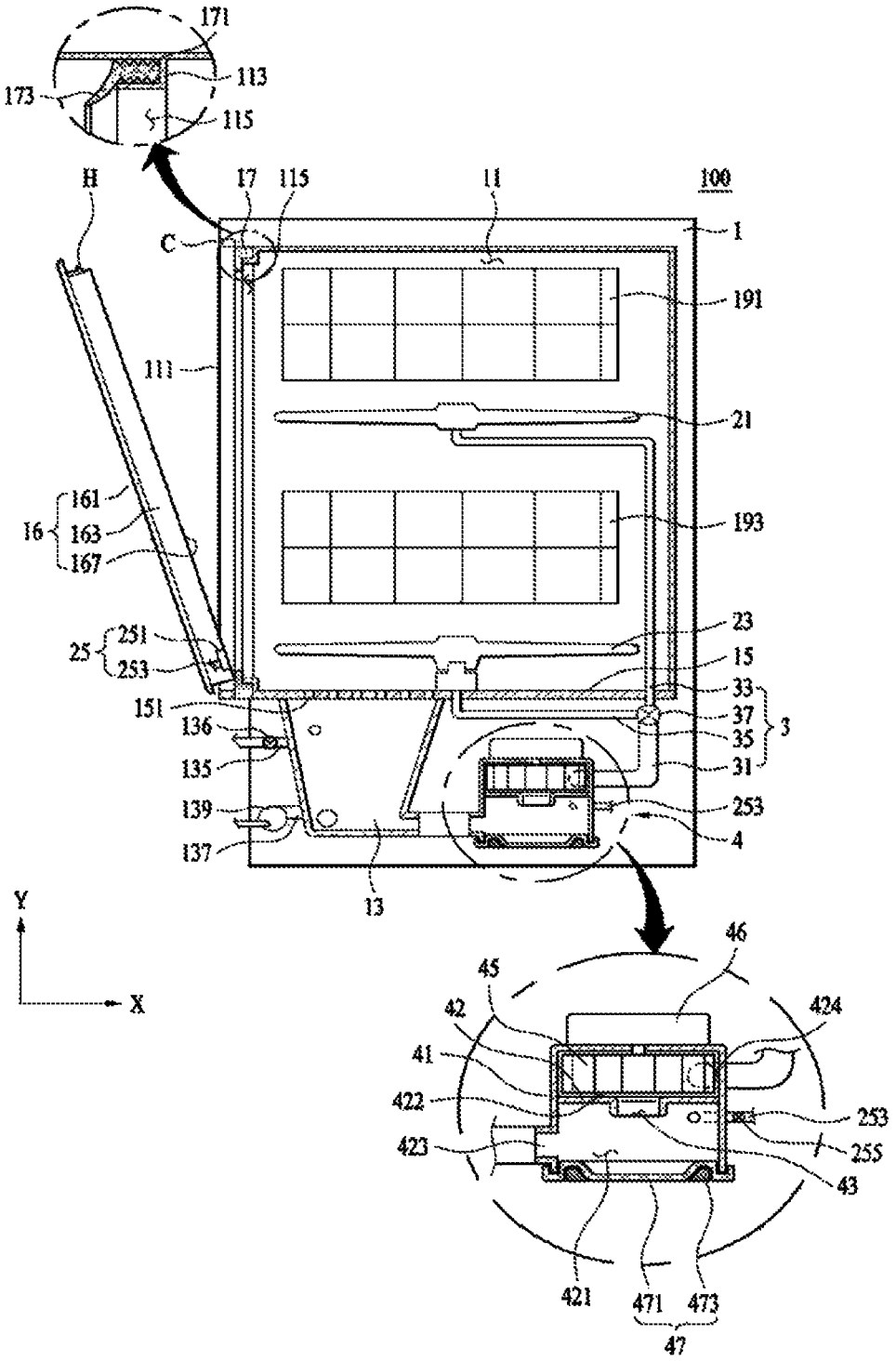

【Figure 2】
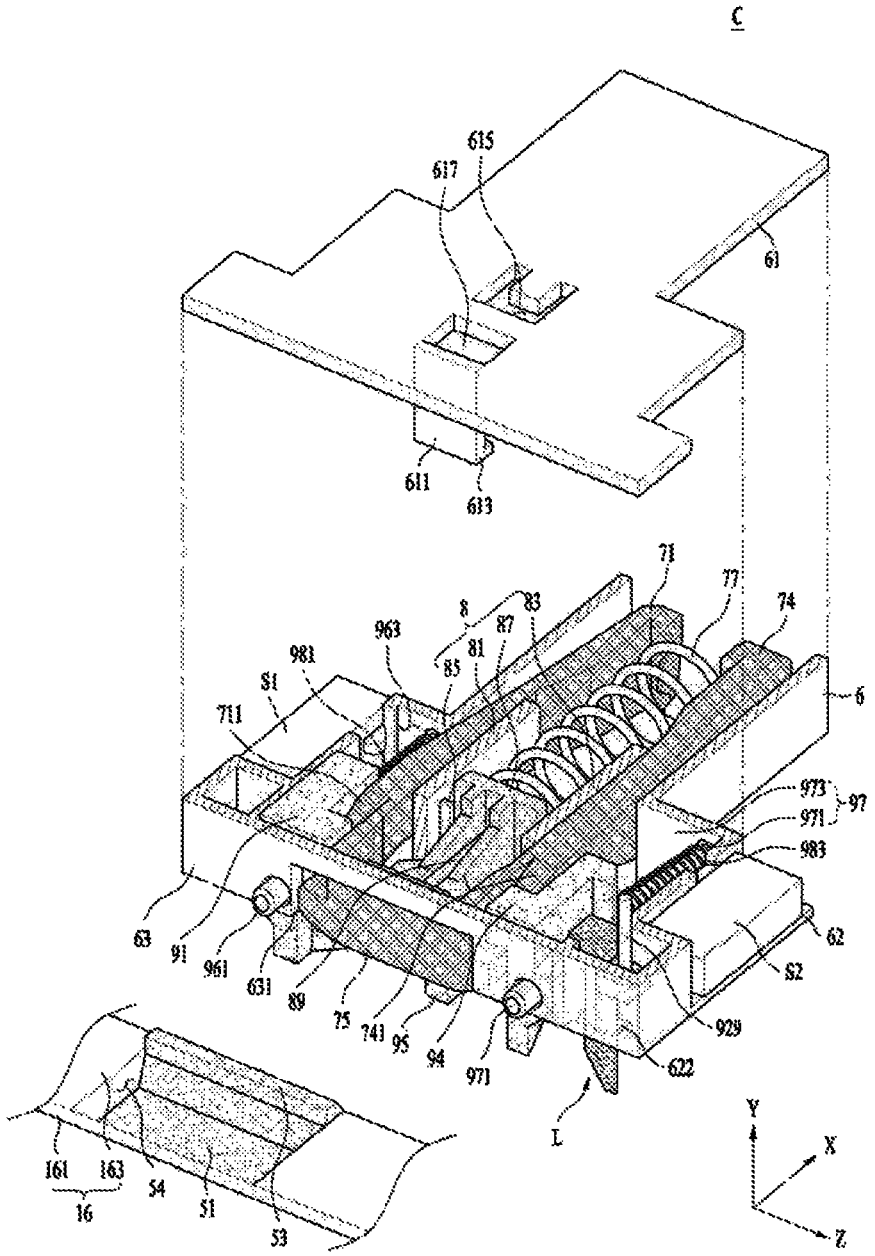

【Figure 3】
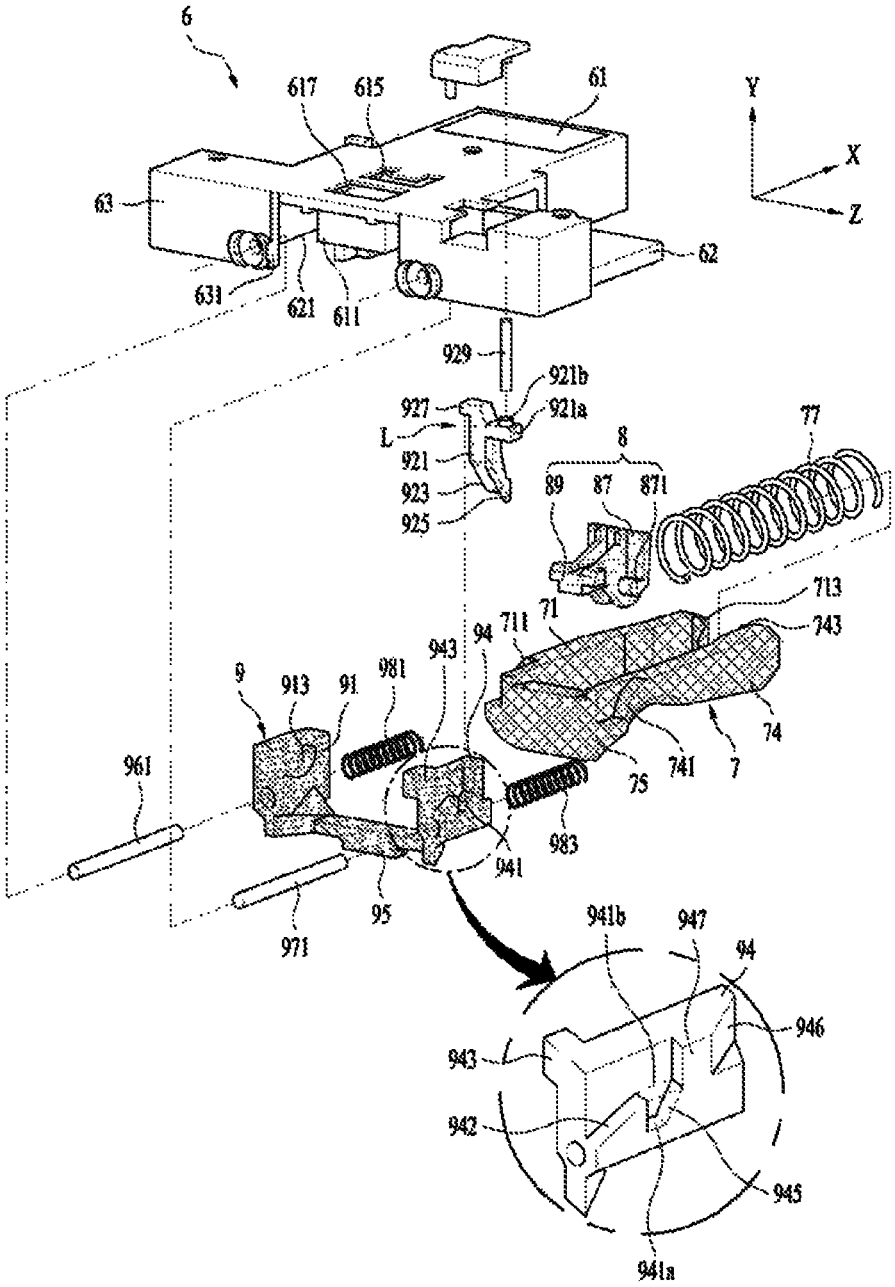

【Figure 4】
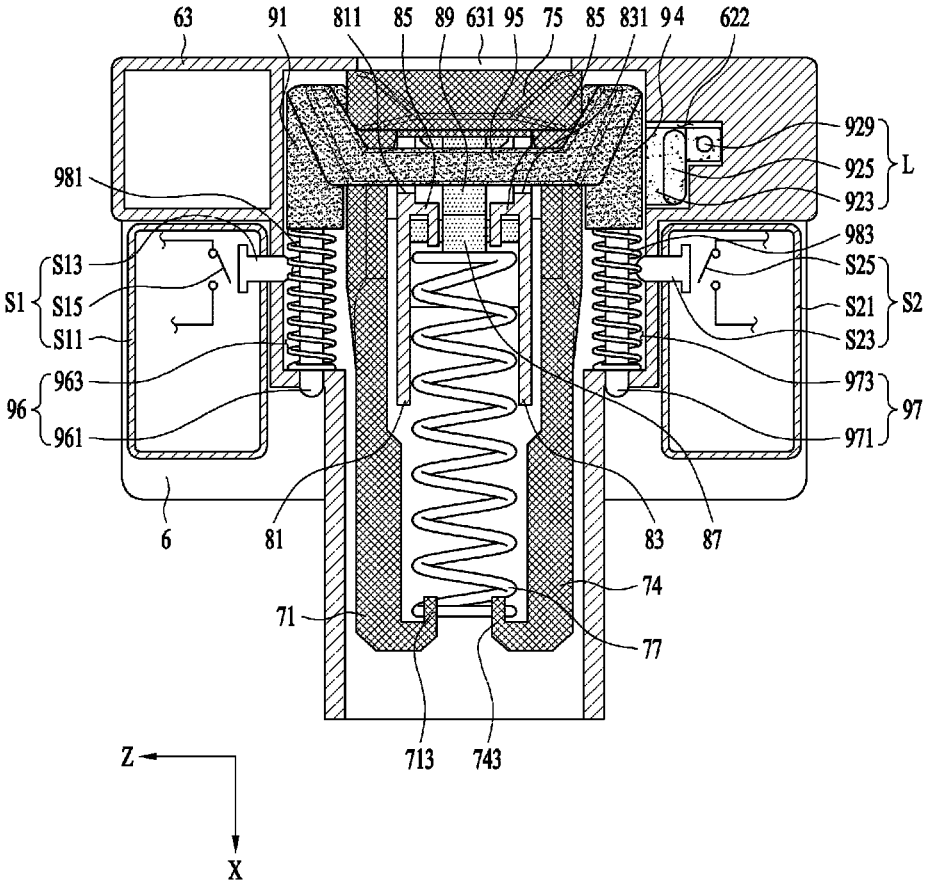
【Figure 5】
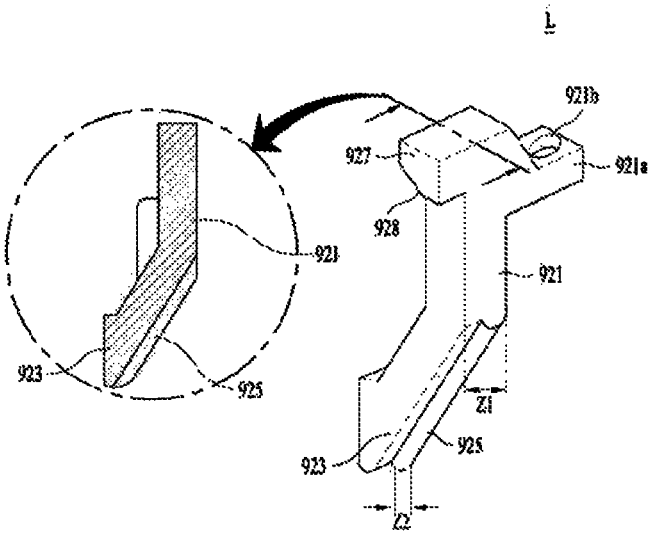

【Figure 6】
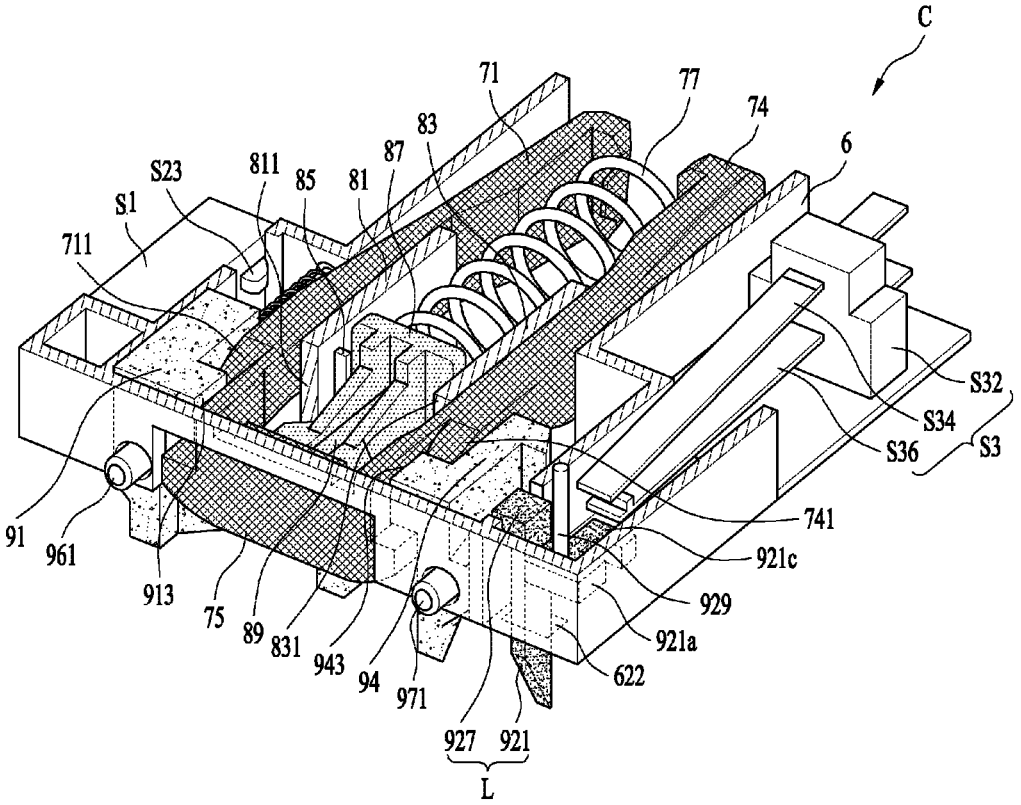

【Figure 7】
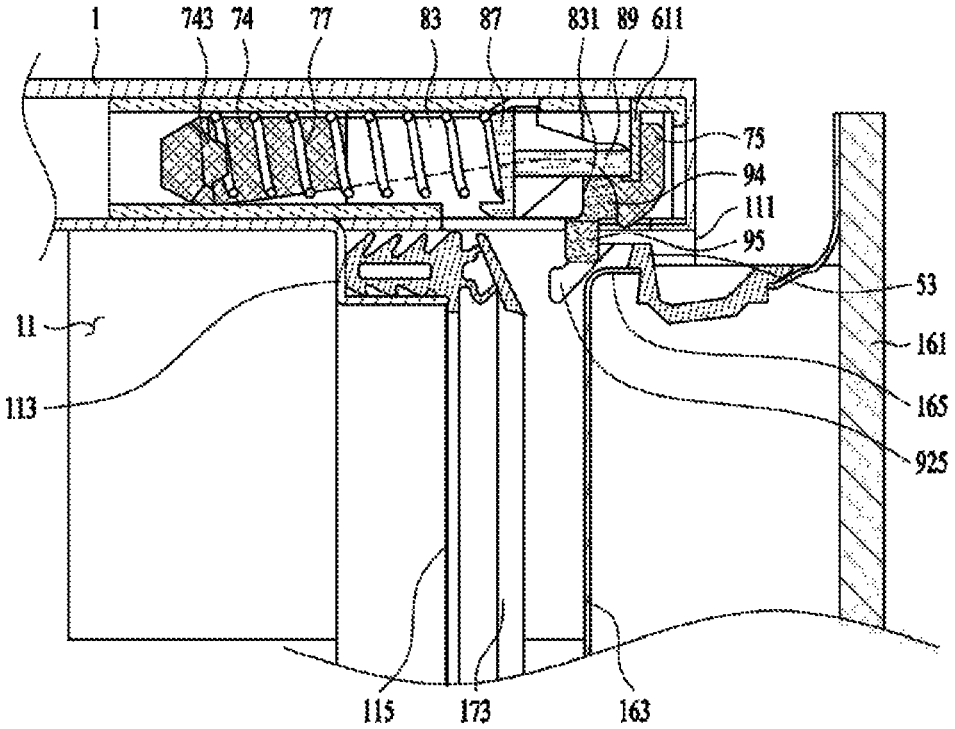
【Figure 8】
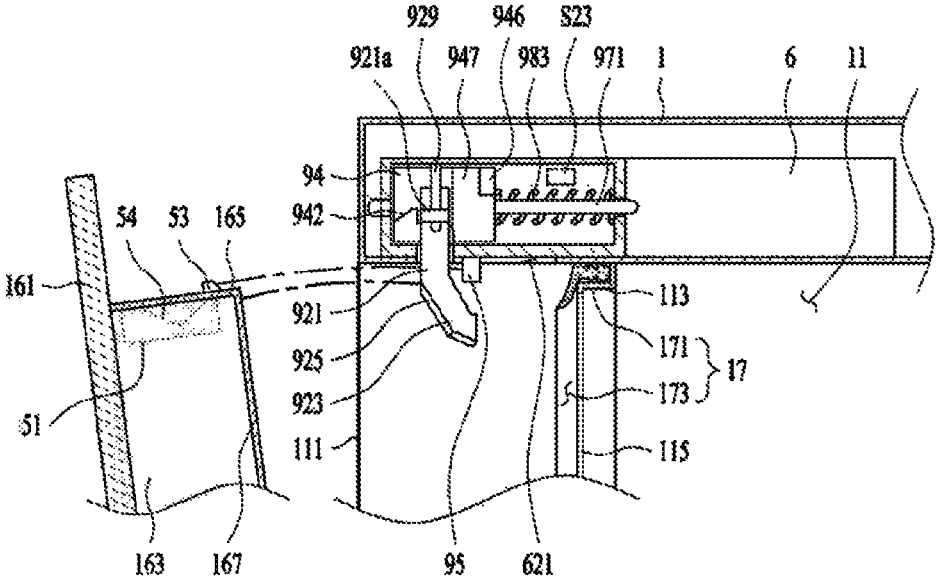

【Figure 9】
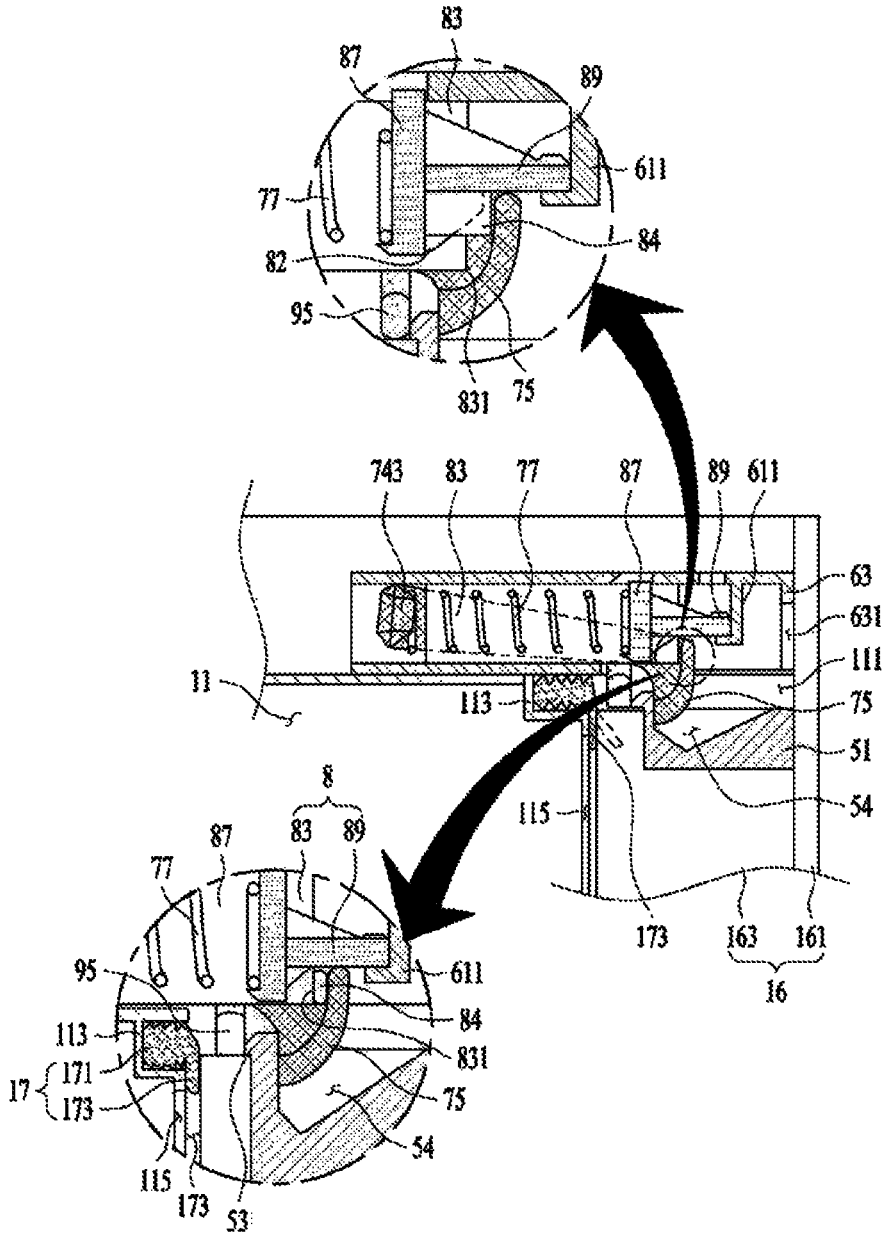

【Figure 10】
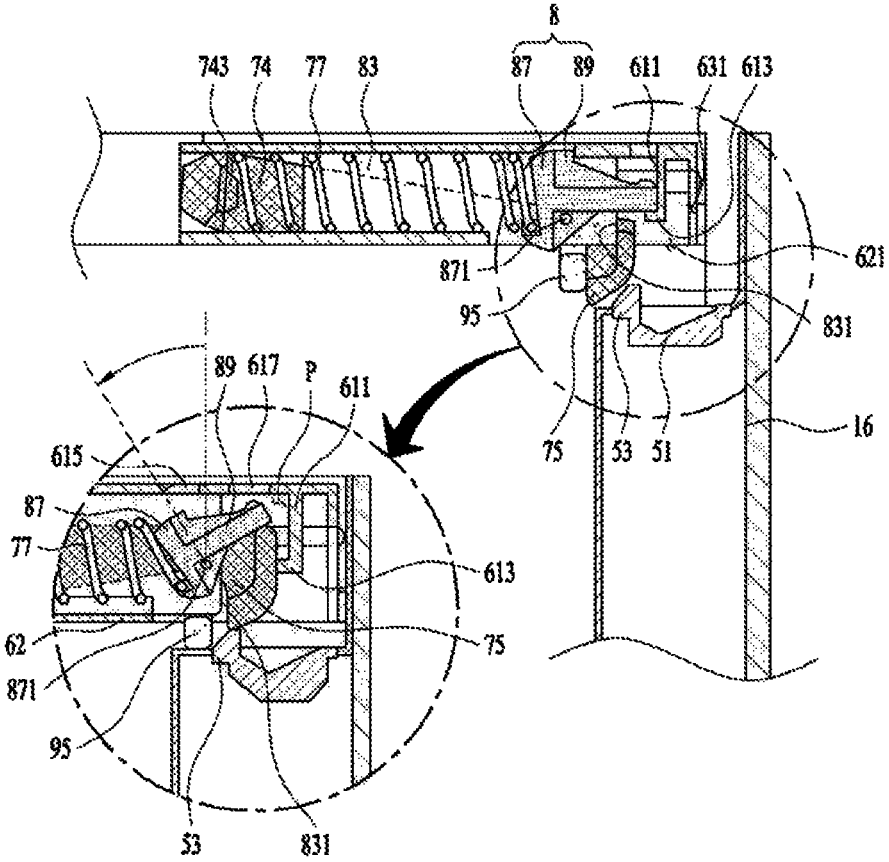
【Figure 11】
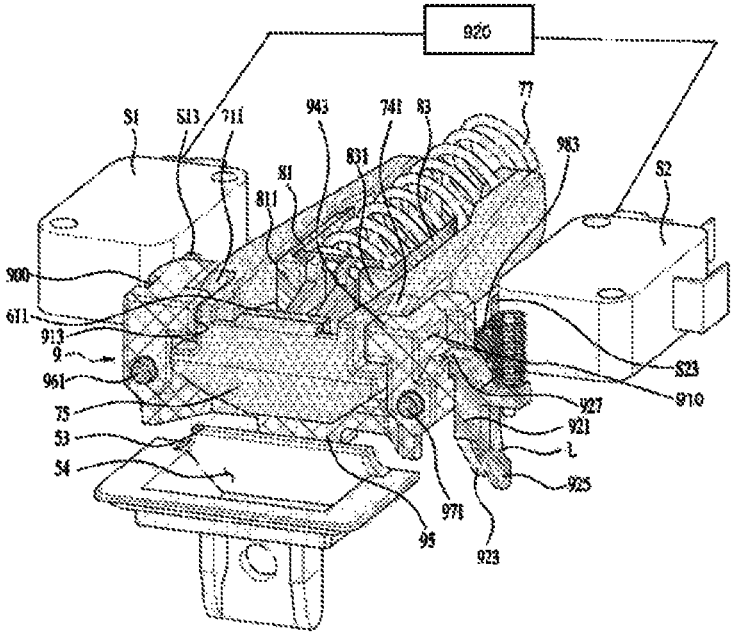

【Figure 12】
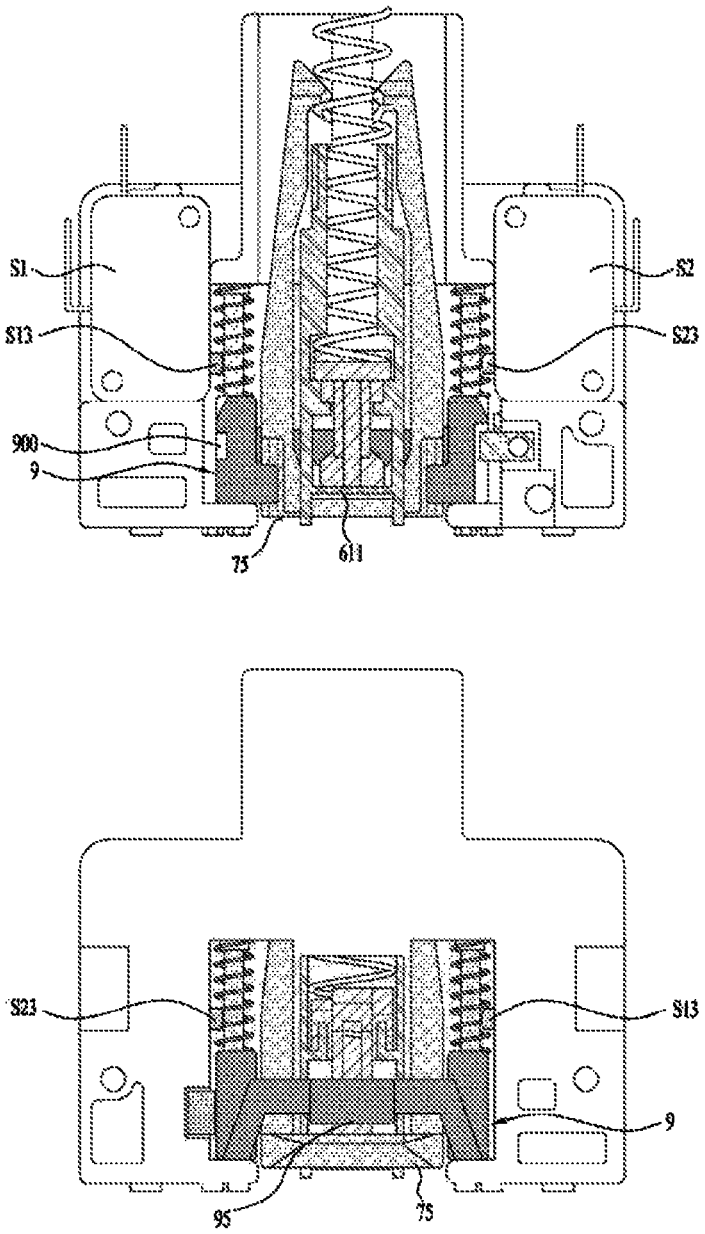

【Figure 13】
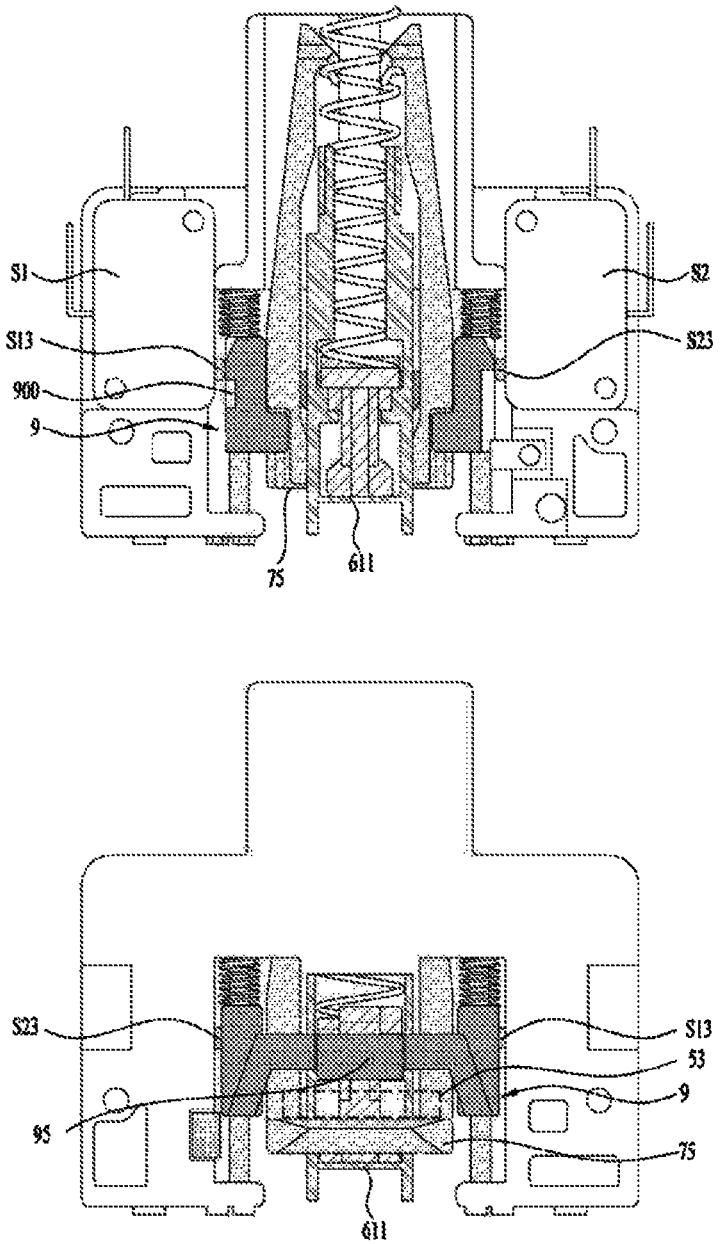

【Figure 14】
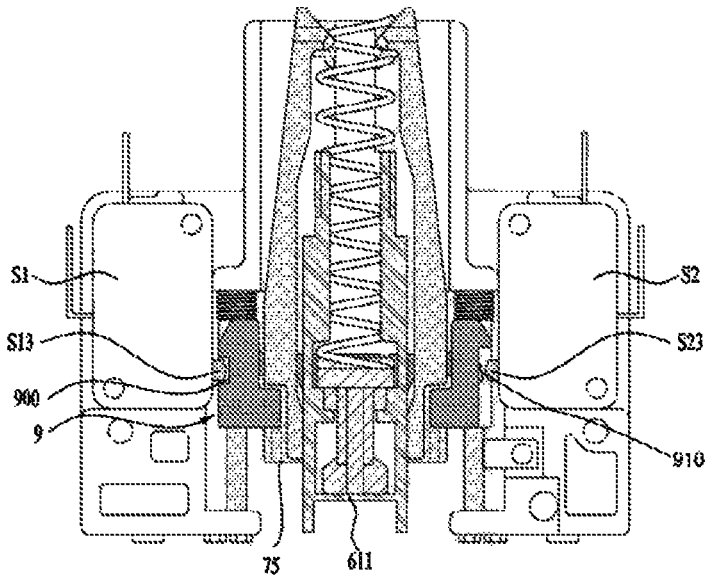
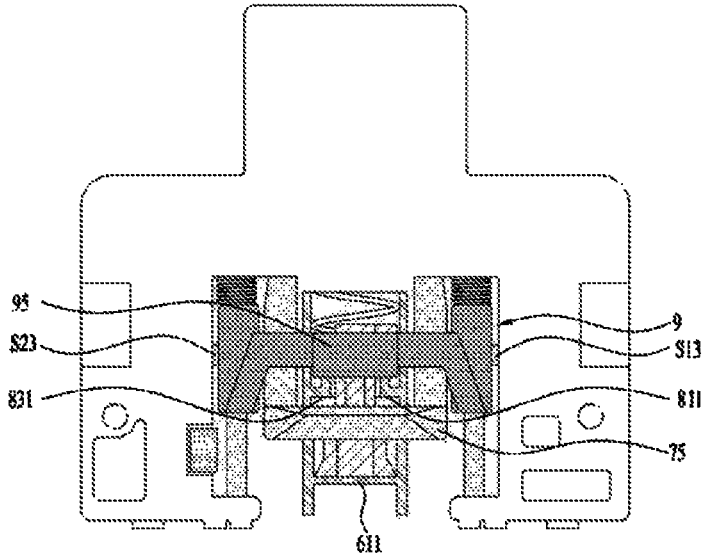

【Figure 15】
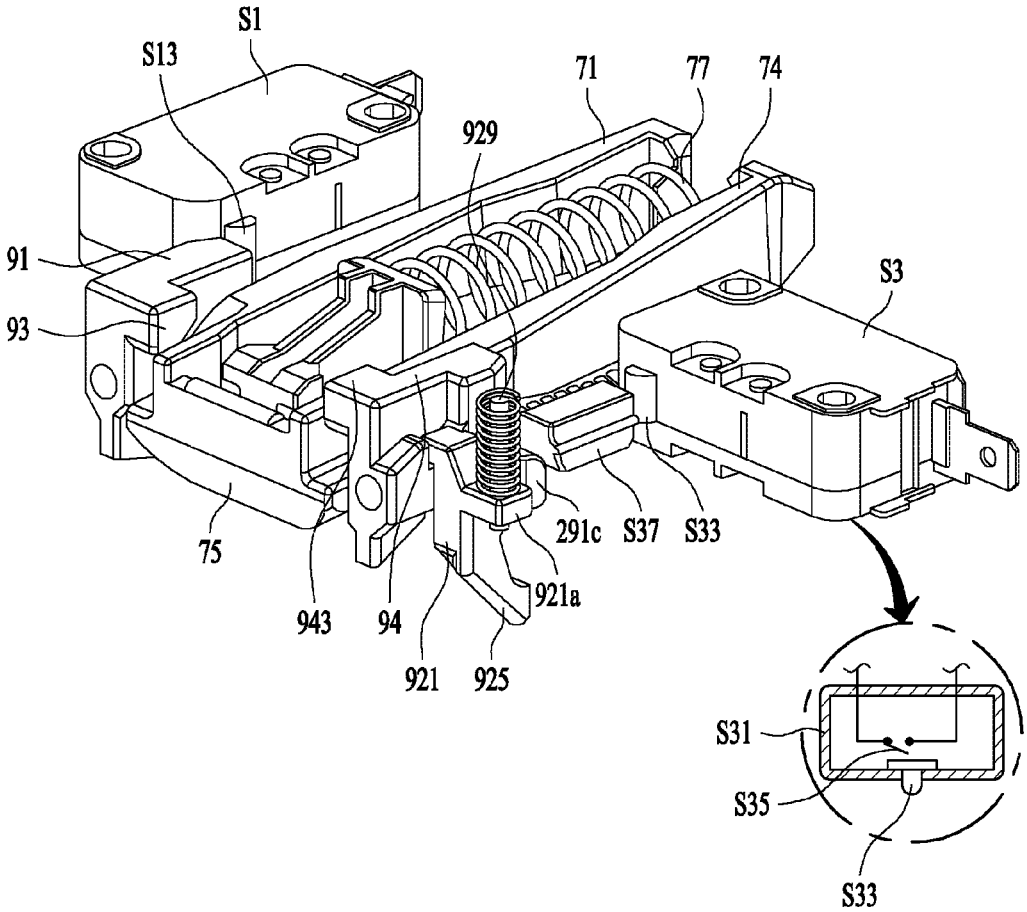

【Figure 16】
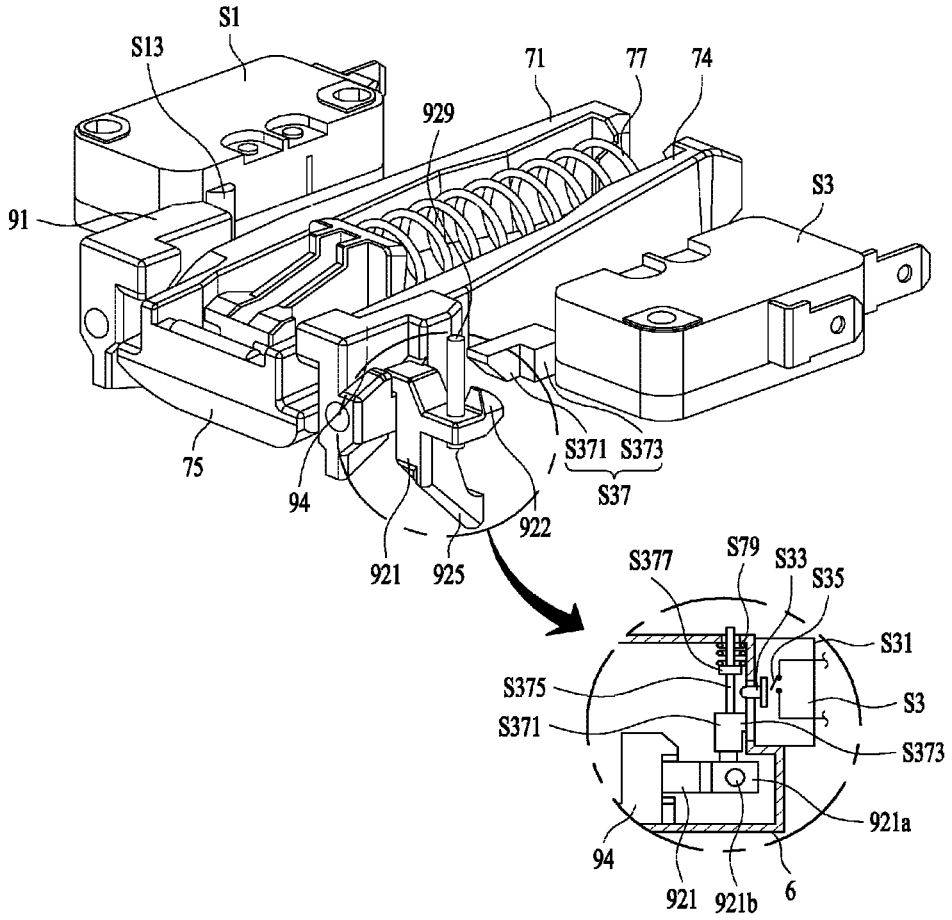

LOCK AND HOME APPLIANCE HAVING THE SAME

This application is a Divisional of U.S. patent application Ser. No. 15/465,010, filed on Mar. 21, 2017, now allowed, which claims the benefit of Korean Patent Application No. 10-2016-0037154, filed on Mar. 28, 2016, Korean Patent Application No. 10-2016-0084695, filed on Jul. 5, 2016, and Korean Patent Application No. 10-2017-0001232, filed Jan. 4, 2017, which are hereby incorporated by reference as if fully set forth herein.

BACKGROUND OF THE INVENTION

Field of the Invention

The present invention relates to a lock and a home appliance having the same.

Discussion of the Related Art

In general, conventional apparatuses having doors, including home appliances, each include a cabinet, a storage space defined in the cabinet for receiving objects, and a door for opening and closing an introduction port communicating with the storage space.

The door is separably fixed to the cabinet via a lock. In general, a conventional lock includes a holder provided at the door and a coupling unit provided at the cabinet, the holder being separably coupled to the coupling unit.

The conventional lock having the above structure is designed such that force necessary to fix the door to the cabinet (i.e. force necessary to couple the holder to the coupling unit) and force necessary to separate the door from the cabinet (i.e. force necessary to separate the holder from the coupling unit) are the same.

In addition, in a home appliance (e.g. a dishwasher, a washer, or a dryer) in which the pressure in the storage space may be increased during operation thereof, the lock must be designed to provide sufficient fastening force to prevent the door from being separated from the cabinet even when the pressure in the space communicating with the introduction port is increased.

In the case in which the conventional lock provides sufficient fastening force to prevent the door from being separated from the cabinet during operation of the home appliance, it is possible to prevent the door from being opened, and thus prevent the introduction port from being opened, during the operation of the home appliance. When the holder is coupled to the coupling unit to close the introduction port, however, a user must apply excessive force to the door.

SUMMARY OF THE INVENTION

Accordingly, the present invention is directed to a lock and a home appliance having the same that substantially obviate one or more problems due to limitations and disadvantages of the related art.

An object of the present invention is to provide a lock configured such that force that a user is required to apply to a door in order to close an introduction port is smaller than force that the user is required to apply to the door in order to open the introduction port and a home appliance having the same.

Another object of the present invention is to provide a lock including a holder and a fastening unit provided respectively at a cabinet having therein an introduction port and a door for opening and closing the introduction port and a home appliance having the same.

Another object of the present invention is to provide a lock that is capable of preventing dislocation of a fastening unit, which is separably coupled to a holder, and a home appliance having the same.

Another object of the present invention is to provide a lock that is capable of performing a function of fixing a door to a cabinet even when a fastening unit is dislocated and a home appliance having the same.

Another object of the present invention is to provide a lock configured such that a holder and a fastening unit can be easily coupled to each other and such that the fastening unit is prevented from being separated from the holder when the holder and the fastening unit are coupled to each other and a home appliance having the same.

Another object of the present invention is to provide a lock configured such that a holder and a fastening unit can be coupled to each other when the fastening unit moves to a position where the fastening unit is coupled to the holder even when a door to an introduction port is not closed and a home appliance having the same.

Another object of the present invention is to provide a lock that is capable of generating a sound signal informing a user that the door to the introduction port is closed when the door to the introduction port is closed and a home appliance having the same.

Another object of the present invention is to provide a lock that is capable of preventing an excessive increase in the magnitude of a sound signal generated when a door to an introduction port is closed and a home appliance having the same.

A further object of the present invention is to provide a lock including a sensing unit for determining whether a fastening unit is coupled to a holder and whether a door to an introduction port is closed and a home appliance having the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lock for separably fixing a door to a cabinet having an introduction port therein, the lock includes a holder provided at one of the cabinet or the door; a housing provided at the other of the cabinet or the door; a first stopper included in the housing; a fastening unit separably coupled to the first stopper so as to be coupled to the holder when separated from the first stopper; an actuation unit to reciprocate in the housing, wherein when the door is moved so as to close the introduction port, the actuation unit moves away from the introduction port in contact with the holder, and wherein the actuation unit separates the fastening unit from the first stopper while being moved away from the introduction port; a first elastic member for providing necessary force to move the fastening unit away from the introduction port when the fastening unit is separated from the first stopper; a second elastic member for providing necessary force to move the actuation unit toward the introduction port; and an actuation unit lock for fixing the actuation unit to the housing when not in contact with the door and releasing coupling between the actuation unit and the housing when in contact with the door.

The fastening unit may include a fastening body separably coupled to the first stopper, wherein the fastening body is coupled to the holder when separated from the first stopper; and a first body and a second body extending from opposite ends of the fastening body in a direction away from the introduction port. The actuation unit may include a first slide and a second slide to reciprocate in the housing, wherein the first slide and the second slide are spaced apart from each other, defining a space for receiving the first body and the second body; a transfer part for connecting the first slide and the second slide, wherein the transfer part is moved away from the introduction port by the holder; and a body push part, provided on at least one of the first slide and the second slide for contacting at least one of the first body and the second body depending on a position of the transfer part, to separate the fastening body from the first stopper, and wherein the actuation unit lock is separably coupled to at least one of the first slide and the second slide.

The actuation unit lock may contact the door to release the coupling between the actuation unit and the housing before the holder contacts the transfer part.

The actuation unit lock may include a lock body separably coupled to the second slide; and a lock body extension part connected to the lock body through the housing such that a free end of the lock body extension part is exposed to an outside of the housing, wherein the lock body extension part separates the lock body from the second slide when the free end contacts the door.

The lock body extension part may be inclined away from the introduction port.

The lock may further include a contact protrusion protruding from the lock body extension part such that the door contacts the contact protrusion. The contact protrusion may have a smaller width than the lock body extension part.

The lock may further include a slide fastening part protruding from the lock body toward the second slide; a lock receiving recess provided in the second slide to receive the slide fastening part; and a first incline inclined downward from an inlet of the lock receiving recess toward a front surface of the second slide for defining a movement path of the slide fastening part.

The lock may further include a lock body guide fixed to the housing, the lock body being provided in a direction intersecting a movement direction of the second slide; and a guide insertion hole provided in the lock body for allowing a free end of the lock body guide to be inserted thereinto.

The lock may further include a sensing unit for determining whether the fastening body is separated from the first stopper.

The sensing unit may include a first contact part to contact the first slide when the first slide moves to a position where the fastening body is separated from the first stopper; and a first switch for generating an electrical signal or interrupting generation of an electrical signal when the first contact part contacts the first slide.

The sensing unit may include a first contact part to contact at least one of the first body and the second body when the fastening body is separated from the first stopper; and a first switch for generating an electrical signal or interrupting generation of an electrical signal when the first contact part contacts the at least one of the first body and the second body.

The sensing unit may include a second contact part to contact the second slide when the second slide moves to a position where the fastening body is separated from the first stopper; and a first switch for generating an electrical signal when the second contact part contacts the second slide.

The lock may further include a slide fastening part protruding from the lock body toward the second slide; a lock receiving recess provided in the second slide to receive the slide fastening part; a contact surface provided on the second slide for contacting the second contact part when the second slide moves to the position where the fastening body is separated from the first stopper; and a support surface located between the lock receiving recess and the contact surface for preventing the second contact part from being inserted into the lock receiving recess.

The lock may further include a second incline inclined upward from a bottom surface of the lock receiving recess toward the support surface; and a fastening part incline provided on the slide fastening part, wherein the fastening part incline has an angle corresponding to an angle of the second incline.

The lock may further include a lock sensing unit for determining whether the lock body is separated from the second slide.

The lock sensing unit may include a contact point support part fixed to the housing, a first contact point fixed to the contact point support part, and a second contact point, the fixed end of which is fixed to the contact point support part and the free end of which contacts the lock body, the second contact point being configured to contact the first contact point and to generate an electrical signal when the lock body is separated from the second slide.

The lock sensing unit may include a third switch provided in the housing and configured to generate an electrical signal or interrupting the generation of an electrical signal; a third contact part to operate the third switch; and a push part configured to be operated by the lock body for pushing the third contact part to operate the third switch when the lock body moves in the direction in which the lock body is separated from the second slide.

The push part may be configured to reciprocate between the lock body and the third contact part.

The push part may include a push part body configured to contact the lock body; a push protrusion provided on the push part body and configured to push the third contact part when the lock body is separated from the second slider; and a body spring to push the push part body toward the lock body.

The first elastic member may remain compressed when the fastening body is supported by the first stopper and moves the fastening body away from the introduction port when the fastening body is separated from the first stopper. The second elastic member may be compressed by at least one of the first slide and the second slide while the actuation unit moves to a position at which the fastening body is separated from the first stopper. The necessary force to compress the first elastic member may be set to be larger than the necessary force to compress the second elastic member.

The body push part may include a first body push part provided at the first slide for pushing the first body such that the fastening body is separated from the first stopper when the transfer part is moved toward the tub and a second body push part provided at the second slide for pushing the second body such that the fastening body is separated from the first stopper when the transfer part is moved toward the tub.

The lock may further include a first body incline provided at the first body, the first body incline being inclined upward away from the introduction port, the first body incline contacting the first body push part when the transfer part is moved away from the introduction port, and a second body incline provided at the second body, the second body incline being inclined upward away from the introduction port, the second body incline contacting the second body push part when the transfer part is moved away from the introduction port.

The lock may further include a second stopper located in the housing and defining a movement limit point of the fastening body, wherein the second stopper is separated from the first stopper.

The lock may further include a first plate and a second plate located in a space defined between the first body and the second body for providing a space for receiving the first elastic member. The second stopper may include at least one selected from between one surface of the first plate, which faces the first stopper, and one surface of the second plate, which faces the first stopper.

The lock may further include a support body rotatably fixed to the first plate and the second plate and an extension part extending from the support body toward the first stopper. One end of the first elastic member may be fixed to the support body, and the other end of the first elastic member may be fixed to at least one selected from between the first body and the second body. The second stopper may locate the fastening body, separated from the first stopper, below the extension part.

The lock may further include a damper provided at one selected from between the fastening body and the second stopper for absorbing impact generated when the fastening body collides with the second stopper.

The lock may further include a damper fixed to the support body for preventing the fastening body from colliding with the second stopper.

The lock may further include a first push release part formed by concavely bending a surface of the first slide; a first contact part contacting the first slide when the fastening body, separated from the first stopper, is coupled to the holder, wherein the first contact part is inserted into the first push release part so as not to contact the first slide when the fastening body, separated from the first stopper, is supported by the second stopper; and a first switch for generating an electrical signal or interrupting generation of an electrical signal when the first contact part contacts the first slide.

The lock may further include a second push release part formed by concavely bending a surface of the second slide; a second contact part contacting the second slide when the fastening body, separated from the first stopper, is coupled to the holder, wherein the second contact part is inserted into the second push release part so as not to contact the second slide when the fastening body, separated from the first stopper, is supported by the second stopper; and a second switch for generating an electrical signal or interrupting generation of an electrical signal when the second contact part contacts the second slide.

In another aspect of the present invention, a home appliance includes a cabinet having an introduction port therein; a tub provided in the cabinet; a communication hole, through which an interior of the tub communicates with the introduction port; a door comprising a first door body for opening and closing the introduction port and a second door body protruding from the first door body toward the tub for closing the communication hole when the first door body closes the introduction port; a sealing part provided along an edge of the communication hole, the sealing part being compressed between a closing surface of the second door body and the edge of the communication hole when the first door body closes the introduction port; a holder fixed to the door, the holder being located in a space defined between the closing surface and the first door body; a housing provided at the cabinet; a first stopper included in the housing, wherein the first stopper is located between the introduction port and the communication hole; a fastening unit separably supported by the first stopper, wherein the fastening unit is coupled to the holder when separated from the first stopper; an actuation unit to reciprocate in the housing, wherein when the first door body is moved in a direction in which the introduction port is closed, the actuation unit moves toward the communication hole in contact with the holder, and wherein the actuation unit separates the fastening unit from the first stopper while the actuation unit is moved toward the communication hole; a first elastic member for providing necessary force to move the fastening unit toward the communication hole when the fastening unit is separated from the first stopper; a second elastic member for providing necessary force to move the actuation unit toward the introduction port; and an actuation unit lock separably coupled to the actuation unit, wherein the actuation unit lock is separated from the actuation unit such that the actuation unit can reciprocate in the housing when in contact with the closing surface and is coupled to the actuation unit such that a position of the actuation unit is fixed when not in contact with the closing surface.

The fastening unit may include a fastening body separably coupled to the first stopper, the fastening body being coupled to the holder when separated from the first stopper, and a first body and a second body extending from opposite ends of the fastening body so as to be distant from the introduction port. The actuation unit may include a first slide and a second slide configured to reciprocate in the housing, the first slide and the second slide being spaced apart from each other so as to define a space for receiving the first body and the second body, a transfer part for connecting the first slide and the second slide, the transfer part being configured to be moved toward the communication hole by the holder, and a body push part provided on at least one selected from between the first slide and the second slide for contacting at least one selected from between the first body and the second body depending on the position of the transfer part to separate the fastening body from the first stopper. The actuation unit lock may be separably coupled to at least one selected from between the first slide and the second slide.

The range in which the transfer part is reciprocated may be set such that the transfer part cannot contact the sealing part when the closing surface closes the communication hole.

In another aspect of the present invention, a lock for separably fixing a door to a cabinet having an introduction port therein includes a holder provided at the door, a housing provided at the cabinet, a fastening unit separably supported by a first stopper provided at the housing, the fastening unit being coupled to the holder when separated from the first stopper and being biased by a first elastic member so as to be moved away from the introduction port, an actuation unit configured to reciprocate in the housing, the actuation unit being biased by a second elastic member so as to be moved toward the introduction port, the actuation unit contacting the holder and moving away from the introduction port to separate the fastening unit from the first stopper when the door is closed, and a sensing unit for determining whether the fastening unit has been separated from the first stopper and coupled to the holder.

The sensing unit may determine whether the fastening unit has been coupled to the holder depending on the position of the actuation unit when the actuation unit moves away from the introduction port.

The sensing unit may include a first contact part configured to selectively contact the actuation unit when the actuation unit reciprocates in the housing and a first switch for generating an electrical signal or interrupting the generation of an electrical signal when the first contact part contacts the actuation unit. When the fastening unit is coupled to the first stopper, the first contact part may not contact the actuation unit.

When the fastening unit is separated from the first stopper and is coupled to the holder, the first contact part may contact the actuation unit.

When the fastening unit is separated from the first stopper but is not coupled to the holder, the first contact part may not contact the actuation unit.

Meanwhile, the fastening unit may include a fastening body separably coupled to the first stopper, the fastening body being coupled to the holder when separated from the first stopper, and a first body extending from one end of the fastening body so as to be distant from the introduction port.

The actuation unit may include a transfer part configured to contact the holder so as to be moved away from the introduction port, a first slide extending from one end of the transfer part, a first body push part provided at the first slide, the first body push part being configured to contact the first body depending on the position of the transfer part to separate the fastening body from the first stopper.

The sensing unit may include a first contact part provided in the movement path of the first slide so as to be selectively pushed by the first slide and a first switch for generating an electrical signal when the first contact part is pushed by the first slide.

Meanwhile, when the fastening body is separated from the first stopper and is coupled to the holder, the first slide may push the first contact part while moving away from the introduction port, and the first switch may generate an electrical signal.

The lock may include a second stopper located in the housing for defining a movement limit point of the fastening body in the case in which the fastening body is separated from the first stopper but is not coupled to the holder.

The distance that the first slide moves away from the introduction port when the fastening body is coupled to the holder may be greater than the distance that the first slide moves away from the introduction port when the fastening body is stopped by the second stopper.

Meanwhile, the lock may include a first push release part concavely recessed in the first slide for preventing the first contact part from being pushed by the first slide when the fastening body is stopped by the second stopper.

The fastening unit may further include a second body extending from the other end of the fastening body so as to be distant from the introduction port. The actuation unit may further include a second slide extending from the other end of the transfer part and a second body push part provided at the second slide, the second body push part being configured to contact the second body depending on the position of the transfer part to separate the fastening body from the first stopper. The sensing unit may further include a second contact part provided in the movement path of the second slide so as to be selectively pushed by the second slide and a second switch for generating an electrical signal when the second contact part is pushed by the second slide.

Furthermore, the lock may further include a second push release part concavely recessed in the second slide for preventing the second contact part from being pushed by the second slide in the case in which the fastening body is stopped by the second stopper.

In addition, the lock may include a controller connected to the first switch and the second switch. When neither the first contact part nor the second contact part is pushed, the controller may determine that the door is not closed.

In a further aspect of the present invention, a home appliance includes a cabinet having an introduction port therein, a door hinged to the cabinet for opening and closing the introduction port, a holder provided at the door, a housing provided at the cabinet, a fastening unit separably supported by a first stopper, provided at the housing, the fastening unit being coupled to the holder when separated from the first stopper and being biased by a first elastic member so as to be moved away from the introduction port, an actuation unit configured to reciprocate in the housing, the actuation unit being biased by a second elastic member so as to be moved toward the introduction port, the actuation unit contacting the holder and moving away from the introduction port to separate the fastening unit from the first stopper when the door is closed, and a sensing unit for determining whether the fastening unit has been separated from the first stopper and coupled to the holder.

The fastening unit may include a fastening body separably coupled to the first stopper, the fastening body being coupled to the holder when separated from the first stopper, and a first body and a second body extending from opposite ends of the fastening body so as to be distant from the introduction port. The actuation unit may include a transfer part configured to be moved away from the introduction port in the state of contacting the holder, a first slide and a second slide extending from opposite ends of the transfer part for defining a space for receiving the first body and the second body, and a first body push part provided on the first slide for contacting the first body depending on the position of the transfer part to separate the fastening body from the first stopper. The sensing unit may include a first contact part provided in the movement path of the first slide so as to be selectively pushed by the first slide, a first switch for generating an electrical signal when the first contact part is pushed by the first slide, a second contact part provided in the movement path of the second slide so as to be selectively pushed by the second slide, and a second switch for generating an electrical signal when the second contact part is pushed by the second slide.

In this case, the lock may include a controller connected to the first switch and the second switch. When neither the first contact part nor the second contact part is pushed, the controller may determine that the door is not closed.

In addition, upon determining that the door is not closed, the controller may perform control such that the home appliance is not operated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a view showing an example of a home appliance having a lock according to the present invention;

FIGS. 2 to 4 are views showing an example of the lock according to the present invention;

FIG. 5 is a view showing an example of an actuation unit lock provided in the present invention;

FIG. 6 is a view showing an example of a lock sensing unit provided in the present invention;

FIGS. 7 to 9 are views showing the operation of the lock according to the present invention;

FIG. 10 is a view showing a process in which a holder and a fastening unit are coupled to each other in the state in which the lock is abnormal;

FIG. 11 is a view showing another embodiment of the lock according to the present invention;

FIG. 12 is a view showing the state of the lock in the case in which a door to an introduction port is open;

FIG. 13 is a view showing the state of the lock in the case in which the door to the introduction port is closed;

FIG. 14 is a view showing the state of the lock in the case in which an actuation unit moves away from the introduction port even when the door to the introduction port is closed;

FIGS. 15 and 16 are views showing other examples of the lock sensing unit provided in the present invention.

DETAILED DESCRIPTION OF THE INVENTION

Reference will now be made in detail to the preferred embodiments of the present invention, examples of which are illustrated in the accompanying drawings. The construction and control method of an apparatus, a description of which will follow, are provided to explain embodiments of the present invention, rather than to define the scope of the present invention. Wherever possible, the same reference numbers will be used throughout the drawings to refer to the same or like parts.

The present invention relates to a lock for separably fixing a door to a cabinet having an introduction port. FIG. 1 is a view showing an example of a dishwasher having a lock H and C according to the present invention.

The lock H and C may be provided in various home appliances (e.g. a washer, a dryer, and a refrigerator) other than the dishwasher. Hereinafter, a dishwasher 100 having the lock H and C will be described for the convenience of description.

As shown in FIG. 1, the dishwasher 100 may include a cabinet 1, a tub 11 provided in the cabinet for providing a space for receiving objects, spray arms 21 and 23 for spraying water to objects, and a pump 4 for supplying water to the spray arms.

A rack for receiving objects to be washed may be provided in the tub 11. The rack may include an upper rack 191 provided in the upper region of the tub and a lower rack 193 disposed below the upper rack.

The tub 11 communicates with the outside of the cabinet through an introduction port 111. The introduction port 111 is opened and closed by a door 16. Consequently, a user may open the door 16 to withdraw the racks 191 and 193 from the tub 11 through the introduction port 111.

In the case in which it is necessary to seal the interior of the tub 11, the tub 11 may be provided with a communication hole 115, through which the introduction port 111 communicates with the interior of the tub, the door 16 may include a first door body 161 for closing the introduction port 111 and a second door body 163 protruding from the first door body for closing the communication hole 115, and the cabinet 1 may be further provided with a gasket 17 located between the communication hole 115 and the second door body 163.

The second door body 163 is formed in a shape that can be inserted into the introduction port 111 when the first door body 161 closes the introduction port 111. The second door body 163 is provided with a closing surface 167 for closing the communication hole 115 when the first door body 161 closes the introduction port 111.

The gasket 17 may include a fixed part 171 configured to be coupled to a body fixing part 113, which is provided at the cabinet 1, and a sealing part 173 extending from the fixed part toward the edge of the communication hole 115. In this case, when the first door body 161 closes the introduction port 111, the sealing part 173 is pushed toward the communication hole 115 by the closing surface 167, thereby preventing a fluid from being discharged from the tub 11 through the communication hole 115.

Meanwhile, in the case in which the rack includes an upper rack 191 and a lower rack 193, the spray arms may include an upper arm 21 for spraying water to the upper rack 191 and a lower arm 23 for spraying water to the lower rack 193.

The water sprayed to the objects from the spray arms 21 and 23 (i.e. the water remaining in the tub) may be collected in a sump 13. The sump 13 is fixed to a tub bottom surface 15 so as to be located outside the tub 11. The tub bottom surface 15 is provided with a collection hole 151, through which the sump 13 communicates with the interior of the tub 11.

The sump 13 is connected to a water supply source (not shown) via a water supply channel 135. The water supply channel 135 is opened and closed by a valve 136. The water stored in the sump 13 is discharged out of the dishwasher via a drainage channel 137 and a drainage pump 139.

The water stored in the sump 13 is supplied to the spray arms 21 and 23 via a pump 4 and a supply channel 3. The supply channel 3 may include a connection channel 31 connected to the pump 4, a first supply channel 33 for connecting the connection channel and the upper arm 21, and a second supply channel 35 for connecting the connection channel and the lower arm 23.

The upper arm 21 may be rotatably coupled to the first supply channel 33, and the lower arm 23 may be rotatably coupled to the second supply channel 35.

The first supply channel 33 and the second supply channel 35 diverge from the connection channel 31. A switch valve 37 for controlling the opening and closing of the supply channels may be provided at the divergence point where the first supply channel 33 and the second supply channel 35 diverge from the connection channel 31.

The pump 4 may include a pump body 41 fixed in the cabinet 1, a partition wall 42 for partitioning the interior of the pump body 41 into a first pump chamber 421 and a second pump chamber 422, a partition wall through hole 43 provided in the partition wall 42 for allowing the first pump chamber 421 and the second pump chamber 422 to communicate with each other, and an impeller 45 provided in the second pump chamber.

The first pump chamber 421 is connected to the sump 13 via a pump inlet 423 formed through the pump body 41, and the second pump chamber 422 is connected to the connection channel 31 via a pump outlet 424 formed through the pump body 41.

The impeller 45 is rotated by a motor 46, which is fixed to the pump body 41. A rotary shaft of the motor is connected to the impeller 45 through the upper surface of the pump body.

Meanwhile, the first pump chamber 421 is provided at the bottom surface thereof with a heating unit 47. In the case in which the lower surface of the pump body 41 is formed in an open cylindrical shape, the heating unit 47 may define the bottom surface of the first pump chamber 421.

In this case, the heating unit 47 may include a heating plate 471 defining the bottom surface of the first pump chamber 421 and a heater 473 fixed to the heating plate in the state of being located outside the first pump chamber 421. The heating plate may be made of a metal exhibiting high thermal conductivity.

Since the heating unit 47 defines the bottom surface of the first pump chamber 421, the pump 4 may simultaneously perform a function of supplying water to the spray arms 21 and 23 and a function of heating water.

In addition, steam may be supplied into the tub 11 from the heating unit 47, which is provided in the pump 4. To this end, the dishwasher 100 may further include a steam supply unit 25.

The steam supply unit 25 may include a nozzle 251 for spraying steam into the tub 11, a steam supply pipe 253 for connecting the nozzle 251 and the first pump chamber 421, and a steam valve 255 for opening and closing the steam supply pipe.

FIG. 1 shows an example in which the nozzle 251 is provided in the door 16. In this case, the nozzle 251 may be fixed to the lower part of one surface of the door, which defines a wash space.

Meanwhile, in the dishwasher 100 having the above structure, the door 16 is separably fixed to the cabinet 1 through the lock H and C. The lock may include a holder H provided at one selected from between the door 16 and the cabinet 1 and a coupling unit C provided at the other selected from between the door and the cabinet such that the holder H is separably coupled to the coupling unit C.

In a conventional lock, force necessary to fix the door 16 to the cabinet 1 (i.e. force necessary to couple the holder to the coupling unit) and force necessary to separate the door 16 from the cabinet 1 (i.e. force necessary to separate the holder from the coupling unit) are the same.

Meanwhile, in a home appliance (e.g. a dishwasher, a washer, a dryer, or a refrigerator) in which the pressure in a space for receiving objects (e.g. a tub) may be high, the lock must be designed to provide sufficient fastening force to prevent the door from being separated from the cabinet even when the pressure in the tub is high.

In the case in which the conventional lock provides sufficient fastening force to prevent the door from being separated from the cabinet, it is possible to prevent the door from being opened, and thus prevent the introduction port from being opened, during the operation of the home appliance. When the holder is coupled to the coupling unit to close the introduction port, however, the user must apply excessive force to the door.

The lock H and C is characterized in that force necessary to couple the holder H to the coupling unit C is smaller than force necessary to separate the holder H from the coupling unit C.

That is, the lock H and C is characterized in that force applied to the door 16 in order to close the introduction port 111 (i.e. in order to close the communication hole) is smaller than force applied to the door 16 in order to open the introduction port 111.

As previously described, the holder H may be provided at one selected from between the door and the cabinet, and the coupling unit C may be provided at the other selected from between the door and the cabinet. In the following description, the holder H is provided at the door 16, and the coupling unit C is provided at the cabinet 1, for the convenience of description.

As shown in FIG. 2, the holder H may include a holder body 51 fixed to the door 16, a receiving recess 54 provided in the holder body 51 for receiving a fastening body 75 of the coupling unit, a description of which will follow, and a protrusion 53 provided on the holder body 51 for moving a transfer part 95, provided at the coupling unit C, and for preventing the fastening body 75, inserted into the receiving recess 54, from being withdrawn from the receiving recess 54.

The shape of the holder H may be changed depending on the shape of the coupling unit C. In addition, unlike what is shown in FIG. 2, the holder H may include only a receiving recess 54 formed by concavely bending the surface of the door.

As shown in FIG. 3, the coupling unit C may include a housing 6 fixed to the cabinet 1, a first stopper 611 provided at the housing 6, a fastening unit 7 separably coupled to the first stopper so as to be coupled to the holder H when separated from the first stopper, an actuation unit 9 configured to reciprocate in the housing, the actuation unit separating the fastening unit 7 from the first stopper 611 while being moved away from the introduction port 111 by the holder H, a first elastic member 77 for providing force necessary to move the fastening unit 7 away from the introduction port 111 when the fastening unit 7 is separated from the first stopper 611, and a second elastic member 981 and 983 for providing force necessary to move the actuation unit 9 toward the introduction port 111.

The shape of the housing 6 is not particularly restricted as long as the fastening unit 7 and the actuation unit 9 are movable as described above. That is, the housing 6 may be defined in the cabinet 1 so as to guide the movement of the fastening unit 7 and the actuation unit 9. As shown in FIG. 3, the housing 6 may be a separate element, which is coupled to the cabinet 1.

FIG. 3 shows an example in which the housing 6 includes a front surface 63 facing the introduction port 111, an upper surface 61 located at the upper end of the front surface 63, and a lower surface 62 located at the lower end of the front surface 63.

In this case, the lower surface 62 may be provided with a first lower surface through hole 621, through which the protrusion 53 of the holder contacts the fastening unit 7 and through which the transfer part 95, provided at the actuation unit 9, is exposed, and the first stopper 611 may protrude from the upper surface 61 of the housing toward the first lower surface through hole 621.

However, the first lower surface through hole 621 may not be provided depending on the shape of the housing 6. That is, in the structure in which the entirety of the holder H is inserted into the housing 6 so as to be coupled to the fastening unit 7, the first lower surface through hole 621 is not necessary.

The fastening unit 7 may include a fastening body 75 separably provided at the first stopper 611 and a first body 71 and a second body 74 extending from opposite ends of the fastening body 75 so as to be distant from the introduction port 111.

The shapes of the first body 71 and the second body 74 are not particularly restricted as long as the first body 71 and the second body 74 can reciprocate in the housing 6 in the direction parallel to the movement direction of the holder H. FIG. 3 shows an example in which each of the first body 71 and the second body 74 is formed in the shape of a bar extending from the fastening body 75 toward the rear of the housing.

When the first body 71 or the second body 74 is pushed toward the lower surface 62 of the housing by the actuation unit 9, the fastening body 75 may be separated from the first stopper 611. The fastening body 75, separated from the first stopper 611, may be inserted into the receiving recess 54 of the holder.

The actuation unit 9 is a means for separating the fastening body 75 from the first stopper 611, which is characterized by reciprocating in the housing 6. The actuation unit 9 includes a first slide 91 and a second slide 94 configured to reciprocate in the housing and a transfer part 95 for connecting the first slide 91 and the second slide 94, the transfer part being configured to be movable away from the introduction port 111 by the holder H.

The first slide 91 and the second slide 94 are spaced apart from each other so as to define a space for receiving the first body 71 and the second body 74, but are connected to each other via the transfer part 95.

The shapes of the first slide 91 and the second slide 94 are not particularly restricted as long as the first slide 91 and the second slide 94 can reciprocate in the housing 6. FIG. 3 shows an example in which each of the slides 91 and 94 is formed in the shape of a bar parallel to a corresponding one of the first and second bodies 71 and 74.

The shape of the transfer part 95 is not particularly restricted as long as the transfer part 95 can connect the slides 91 and 94 and can be moved away from the introduction port 111 by the protrusion 53 of the holder when the door 16 to the introduction port 111 is closed.

Furthermore, the actuation unit 9 may further include a body push part for pushing at least one of the first and second bodies 71 and 74 toward the lower surface 62 of the housing such that the fastening body 75 moves so as to be separated from the first stopper 611 when the transfer part 95 is moved away from the introduction port 111 by the protrusion 53 of the holder.

In an example, the body push part includes a first body push part 913 provided at the first slide 91 for moving the first body 71 toward the lower surface 62 of the housing and a second body push part 943 provided at the second slide 94 for moving the second body 74 toward the lower surface 62 of the housing.

The first body push part 913 may protrude from the first slide 91 toward the second slide 94 (i.e. toward the first body), and the second body push part 943 may protrude from the second slide 94 toward the first slide 91 (i.e. toward the second body).

In this case, the first body 71 may be provided with a first body incline 711 contacting the first body push part 913, and the second body 74 may be provided with a second body incline 741 contacting the second body push part 943.

The first body incline 711 may contact the first body push part 913 only when the first slide 91 moves a predetermined distance away from the introduction port 111. That is, the first body incline 711 may be provided at the region of the first body 71 where the fastening body 75 is located so as to be inclined upward away from the introduction port 111.

Similarly, the second body incline 741 may be provided at the region of the second body 74 where the fastening body 75 is located so as to be inclined upward away from the introduction port 111.

The actuation unit 9 is constituted by the first slide 91 and the second slide 94, located outside the space defined between the first body 71 and the second body 74, in consideration of the possibility of the fastening unit 7 becoming dislocated in the housing 6.

As previously described, the first body 71 and the second body 74 reciprocate in the housing 6, and the fastening body 75 is coupled to the first body 71 and the second body 74. When the first body 71 and the second body 74 are dislocated, therefore, the fastening body 75 may not be coupled to the holder H.

In the present invention, however, the first body 71 and the second body 74 are located in the space defined between the first slide 91 and the second slide 94, thereby minimizing the possibility of the first body and the second body being dislocated in the housing.

Furthermore, even when the first body 71 and the second body 74 are dislocated, the fastening body 75 may, when desired, be separated from the stopper 611 by the first slide 91 and the second slide 94, which are provided outside the first body 71 and the second body 74, respectively.

It is assumed that the fastening unit 7 is dislocated in the state in which the actuation unit 9 includes only a single slide. In this case, when the transfer unit 95 is moved away from the introduction port 111 by the holder H, the actuation unit 9, which includes only a single slide, may push the first body 71 or the second body 74 earlier than a predetermined time, or may push neither the first body 71 nor the second body 74.

In the case in which the actuation unit 9 includes a first slide and a second slide spaced apart from each other so as to provide a space for receiving the first body 71 and the second body 74, however, the fastening body 75 may be uniformly separated from the stopper 611. The reason for this is that, since the first slide 91 and the second slide 92 are means for minimizing the range in which the first body 71 and the second body 74 are dislocated, variation in the time at which one of the body push parts 913 and 943 contacts one of the bodies 71 and 74 may be minimized.

Meanwhile, as shown in FIG. 4, the actuation unit 9 may include a first guide 96 for guiding the movement of the first slide 91 and a second guide 97 for guiding the movement of the second slide 94.

The first guide 96 may include at least one selected from between a first receiving part 963 provided in the housing 6 for defining the movement path of the first slide 91 and a first bar 961 extending through the first slide 91 for defining the movement path of the first slide 91.

Similarly, the second guide 97 may include at least one selected from between a second receiving part 973 provided in the housing 6 for defining the movement path of the second slide 94 and a second bar 971 extending through the second slide 94 for defining the movement path of the second slide 94.

The second elastic member may include at least one selected from between a first spring 981 provided in the first receiving part 963 for pushing the first slide 91 toward the introduction port 111 (i.e. to the front surface of the housing) and a second spring 983 provided in the second receiving part 973 for pushing the second slide 94 toward the introduction port 111.

In the case in which the first bar 961 and the second bar 971 are provided, the first bar 961 may be fixed in the first receiving part 963 in the state of being inserted into the first spring 981, and the second bar 971 may be fixed in the second receiving part 973 in the state of being inserted into the second spring 983. As a result, the respective springs 981 and 983 are prevented from being dislocated or damaged when the first slide 91 and the second slide 94 reciprocate in the respective receiving parts 963 and 973.

In the actuation unit 9 having the above structure, the protrusion 53 of the holder H contacts the transfer part 95 when the door 16 to the introduction port 111 is closed, with the result that the respective slides 91 and 94 move away from the introduction port 111 (i.e. to the rear of the housing).

At this time, the first spring 981 and the second spring 983 are compressed in the respective receiving parts 963 and 973. When external force applied to the transfer part 95 from the holder H is removed (i.e. when the door is moved in the direction in which the introduction port is opened), therefore, the respective slides 91 and 94 may be moved toward the introduction port 111 by restoring force of the first spring 981 and the second spring 983.

One end of the first elastic member 77, which provides force necessary to move the fastening unit 7 away from the introduction port 111 (i.e. to the rear of the housing) when the fastening body 75 is separated from the first stopper 611, may be fixed to the housing 6, and the other end of the first elastic member 77 may be fixed to at least one selected from between a free end of the first body 71 and a free end of the second body 74.

To this end, the housing 6 may be provided with a support unit 8 (see FIG. 3) for supporting one end of the first elastic member 77, and a first coupling recess 713 and a second coupling recess 743, in which the other end of the first elastic member 77 is fixed, may be provided in the free end of the first body 71 and the free end of the second body 74, respectively.

The first elastic member 77 may be a spring configured to remain compressed between the support unit 8 and the coupling recesses 713 and 743 in the state in which the fastening body 75 is supported by the first stopper 611.

One end of the first elastic member 77 is fixed to the support unit 8, which is fixed to the housing 6, and the other end of the first elastic member 77 is fixed to the free ends of the bodies 71 and 74 in the compressed state. In the state in which the fastening body 75 is supported by the first stopper 611, therefore, the first elastic member 77 may provide force necessary to move the free end of the first body 71 and the free end of the second body 74 away from the support unit 8. Consequently, the first elastic member 77 prevents the fastening body 75 from being separated from the first stopper 611 in the state in which the fastening body 75 is supported by the first stopper 611.

When the fastening body 75 is separated from the first stopper 611, however, the length of the first elastic member 77 is increased away from the support unit 8 due to the restoring force thereof. Consequently, the first elastic member 77 may move the fastening body 75 away from the introduction port 111 when the fastening body 75 is separated from the first stopper 611.

In addition, the lock according to the present invention further includes an actuation unit lock L for allowing the fastening unit 7 to be coupled to the holder H only when the door 16 to the introduction port 111 is closed. The actuation unit lock L is a means separably provided at the actuation unit 9 for fixing the position of the actuation unit 9. When the actuation unit lock L contacts the door 16, the actuation unit 9 can reciprocate in the housing 6. When the door 16 does not contact the actuation unit lock L, the position of the actuation unit 9 is fixed by the actuation unit lock L.

The actuation unit lock L may be separably coupled to at least one selected from between the first slide 91 and the second slide 94, provided at the actuation unit. FIG. 2 shows an example in which the actuation unit lock L is separably provided at the second slide 94.

As shown in FIG. 3, the actuation unit lock L may include a lock body 921 configured to reciprocate in the housing 6, the lock body 921 being separably coupled to the second slide 94, and a lock body extension part 923 extending from the lock body 921, the free end of the lock body extension part 923 being exposed to the outside of the housing through the lower surface 62 of the housing.

The lock body 921 may be configured to reciprocate in the height direction (i.e. the Y-axis direction) of the housing 6. In this case, the lock body 921 may be coupled to the second slide 94 via a slide fastening part 927.

The figure shows an example in which the lock body 921 reciprocates in the direction perpendicular to the movement direction of the slide. Alternatively, the lock body 921 may be provided so as not to be parallel to the movement direction of the slide. That is, the angle formed by the movement path of the lock body and the movement path of the slide need not be a right angle, as long as the lock body 921 is provided so as to intersect the movement direction of the slide.

The slide fastening part 927 may be a protrusion protruding from the lock body 921 toward the second slide 94. In this case, the second slide may be provided with a lock receiving recess 941 for receiving the slide fastening part 927.

In addition, the housing may be provided with a lock body guide 929 for guiding the movement of the lock body 921, and the lock body 921 may be further provided with a guide insertion hole 921*b*, into which the lock body guide 929 is inserted.

The lock body guide 929 may be provided so as to be perpendicular to the movement direction of the second slide 94. The guide insertion hole 921*b* may be provided in the lock body 921, or may be formed through a first flange 921*a*, which protrudes from the lock body 921.

The free end of the lock body extension part 923 is inserted through a second lower surface through hole 622 (see FIG. 2) provided in the lower surface 62 of the housing so as to be exposed to the outside of the housing 6. When the door 16 moves in the direction in which the introduction port 111 is closed, therefore, the free end of the lock body extension part 923 contacts the door 16. When the lock body extension part 923 contacts the door 16, the lock body 921 moves toward the upper surface 61 of the housing 6. When the lock body 921 moves in the height direction of the housing 6 (i.e. in the Y-axis direction), the slide fastening part 927 is separated from the lock receiving recess 941.

The lock body extension part 923 may be inclined away from the introduction port 111. When the door 16 contacts the lock body extension part 923, therefore, damage to the lock body extension part 923 is prevented, and the body extension part 923 easily moves toward the second lower surface through hole 622.

Meanwhile, the lock body extension part 923 may be further provided with a contact protrusion 925 in order to minimize frictional force between the door 16 and the lock body extension part 923 when the door 16 contacts the lock body extension part 923.

The contact protrusion 925 may protrude from the lock body extension part 923 while having a width Z2 smaller than the width Z1 (see FIG. 5) of the lock body extension part. In this case, force necessary to be applied to the door 16 in order to close the door is minimized.

The lock receiving recess 941, provided in the second slide, may be located at a lateral surface of the second slide 94 (i.e. the surface of the second slide that faces the lock body). The lock receiving recess 941 may include a bottom surface 941*a*, on which the slide fastening part 927 is supported, and an open surface 941*b* (the inlet of the lock receiving recess), through which the slide fastening part 927 is withdrawn from the lock receiving recess.

The second slide 94 may be provided with a first incline 942 inclined downward from the open surface 941*b* toward the front surface of the second slide. When the door moves in the direction in which the introduction port is closed, the first incline 942 guides the slide fastening part 927, withdrawn from the lock receiving recess 941, to the front surface of the second slide 94. When the door moves in the direction in which the introduction port is opened, the first incline 942 guides the slide fastening part 927 to the lock receiving recess 941.

The actuation unit lock L having the above structure may be configured to be operated by the protrusion 53, provided at the holder. Alternatively, the actuation unit lock L having the above structure may be configured to be operated by the closing surface 167, provided at the door.

The actuation unit lock L is configured to be operated before the protrusion 53, which is provided at the holder, contacts the transfer part 95. Consequently, the actuation unit lock L is located before the transfer part 95 such that the actuation unit lock L is operated by the protrusion 53. Since the space between the transfer part 95 and the front surface 63 of the housing is narrow, however, the actuation unit lock L is configured to be operated by the closing surface 167, rather than by the holder H.

In addition, the protrusion 53 is formed in a shape that is capable of moving the lock body 921 to the position where the slide fastening part 927 is fully withdrawn from the lock receiving recess 941 such that the actuation unit lock L is operated by the protrusion 53, which is provided at the holder. In consideration of the fact that the protrusion 53 must be inserted into the cabinet 1 in order to be coupled to the transfer part 95, it is difficult to increase the height of the protrusion 53. If the height of the protrusion is not increased, the length of the slide fastening part 927 separated from the lock receiving recess 941 becomes short, which reduces the fastening force between the actuation unit lock and the slide. For this reason, the actuation unit lock L is configured to be operated by the closing surface 167, rather than by the holder H.

Furthermore, the lock H and C according to the present invention may further include a sensing unit for sensing whether the door 16 to the introduction port 111 is closed.

As shown in FIG. 2, the sensing unit may include a first sensing unit S1 for sensing whether the first slide 91 has moved to the position where the fastening body 75 is separated from the first stopper 611 and a second sensing unit S2 for sensing whether the second slide 94 has moved to the position where the fastening body 75 is separated from the first stopper 611. In the case in which two sensing units are provided, it is possible to determine whether the door to the introduction port 111 is closed even when one of the sensing units malfunctions.

As shown in FIG. 4, the first sensing unit (i.e. the slide sensing unit) S1 may include a first case S11 fixed to the cabinet 1 or the housing 6, a first contact part S13 configured to contact the first slide 91 when the first slide 91 moves to the position where the fastening body 75 is separated from the first stopper 611, and a first switch S15 provided in the first case for generating an electrical signal when the first contact part contacts the first slide.

The free end of the first contact part S13 may be located in the first receiving part 963, which is provided in the housing. When the first contact part S13 contacts the first slide 91, the first contact part S13 may close the first switch S15 (i.e. a circuit including the first switch may be connected each other). When contact between the first contact part S13 and the first slide 91 is released, the first contact part S13 may open the first switch S15 (i.e. the circuit including the first switch may be disconnected each other).

Meanwhile, at least one selected from between the first slide 91 and the first contact part S13 may be further provided with a means for facilitating contact between the first slide 91 and the first contact part S13. That is, the first slide 91 may be provided with an incline (not shown) for connecting the rear surface of the first slide 91 and the lateral surface of the first slide, and the free end of the first contact part S13 may be curved.

Alternatively, the first sensing unit (i.e. the slide sensing unit) S1 may include a first magnet provided at the first slide 91 and a first signal generator for sensing magnetic force of the first magnet and generating an electrical signal when the first slide 91 moves to the position where the fastening body 75 is separated from the first stopper 611.

In addition, the first sensing unit S1 may be configured to determine whether the fastening body 75 is separated from the first stopper 611. When external force is applied to the lock, the fastening body 75 may be separated from the first stopper 611 even when the door to the introduction port is not closed. A controller provided in the home appliance may determine the above situation.

The first sensing unit (i.e. the fastening body sensing unit) S1, which determines whether the fastening body 75 is separated from the first stopper 611, may be configured to contact at least one selected from between the first body 71 and the second body 74 when the fastening body 75 is separated from the first stopper 611.

In addition, the first sensing unit S1, which determines whether the fastening body 75 is separated from the first stopper 611, may be configured such that the first body is provided at one selected from among the first body 71, the second body 74, and the fastening body 75 and such that the first signal generator senses magnetic force of the first magnet when the fastening body 75 is separated from the first stopper 611.

The second sensing unit S2 may include a second case S21 fixed to the cabinet 1 or the housing 6, a first contact part S13 configured to contact the second slide 94 when the second slide 94 moves to the position where the fastening body 75 is separated from the first stopper 611, and a second switch S25 provided in the second case for generating an electrical signal when the second contact part contacts the second slide.

The free end of the second contact part S23 may be located in the second receiving part 973, which is provided in the housing. When the second contact part S23 contacts the second slide 94, the second contact part S23 may close the second switch S25 (i.e. a circuit including the second switch may be connected each other). When contact between the second contact part S23 and the second slide 94 is released, the second contact part S23 may open the second switch (i.e. the circuit including the second switch may be disconnected each other).

Meanwhile, at least one selected from between the second slide 94 and the second contact part S23 may be further provided with a means for facilitating contact between the second slide 94 and the second contact part S23. That is, the second slide 94 may be provided at the rear thereof with a contact surface 946 (see FIG. 3), and the free end of the second contact part S23 may be curved (see FIG. 4). The contact surface 946 may be an incline for connecting the rear surface of the second slide 94 and the lateral surface of the second slide.

In the lock having the above structure, when the second slide 94 moves to the position where the fastening body 75 is separated from the first stopper 611, the second contact part S23 may be inserted into the lock receiving recess 941. When the second contact part S23 is inserted into the lock receiving recess 941, the second slide 94 may not return to the initial position thereof regardless of restoring force of the second elastic member 981 and 983.

In order to solve this problem, a support surface 947 for preventing the second contact part S23 from being inserted into the lock receiving recess 941 may be further provided between the lock receiving recess 941 and the contact surface 946.

In order to maximize the area of the support surface 947, the lock receiving recess 941 may be further provided with a second incline 945 inclined upward from the bottom surface 941*a* toward the support surface 947. In this case, the slide fastening part 927 of the actuation unit lock may be further provided with a fastening part incline 928 (see FIG. 5) having an angle corresponding to the angle of the second incline 945.

Alternatively, the second sensing unit S2 may include a second magnet provided at the second slide 94 and a first signal generator for sensing magnetic force of the second magnet and generating an electrical signal when the second slide 94 moves to the position where the fastening body is separated from the first stopper.

As shown in FIG. 6, the lock according to the present invention may further include a lock sensing unit S3 for sensing whether the actuation unit lock L is separated from the second slide 94. The lock sensing unit S3 may include a contact point support part S32 fixed to the housing, a first contact point S34 fixed to the contact point support part, and a second contact point S36, the fixed end of which is fixed to the contact point support part and the free end of which contacts the lock body 921.

The free end of second contact point S36 is configured to contact the first contact point S34 when the lock body 921 is separated from the lock receiving recess 941, provided in the second slide. To this end, the actuation unit lock L may further include a second flange 921*c* protruding from the first flange 921*a* for supporting the free end of the second contact point S36.

Hereinafter, the operation of the lock H and C having the above structure will be described with reference to FIGS. 7 to 9.

FIG. 7 shows the state in which the introduction port 111 is open as the result of opening the door 16. In this case, the fastening body 75 remains supported by the stopper 611 due to force applied by the first elastic member 77.

When the user moves the door 16 toward the introduction port 111, the actuation unit lock L is separated from the second slide 94. When the actuation unit lock L is separated from the second slide 94, the transfer part 95 is moved away from the introduction port by the protrusion 53 of the holder, which will be described hereinafter in more detail.

As shown in FIG. 8, the closing surface 167, provided at the second door body 163, is further distant from the first door body 161 than the protrusion 53 of the holder. That is, since the protrusion 53 is located so as not to escape a space 165 defined between the first door body 161 and the closing surface 167, the closing surface 167 is closer to the introduction port 111 than the protrusion 53.

While the first door body 161 moves in the direction in which the introduction port 111 is closed, therefore, the actuation unit lock L contacts the closing surface 167, provided at the second door body. When the actuation unit lock L contacts the closing surface 167, the lock body extension part 923 moves toward the housing 6. When the lock body extension part 923 moves toward the housing 6, the slide fastening part 927 (see FIG. 3) is separated from the lock receiving recess 941, provided in the second slide.

When the slide fastening part 927 is separated from the lock receiving recess 941, the second slide 94 is movable in the housing 6. When the protrusion 53, provided at the holder, contacts the transfer part 95, provided at the actuation unit, the first slide 91 and the second slide 94 moves away from the introduction port 111 (i.e. toward the communication hole). At this time, the first slide 91 and the second slide 94 compress the second elastic member 981 and 983.

Meanwhile, while the first slide and the second slide move away from the introduction port 111, the first body 71 and the second body 74, which are provided at the fastening u nit 7, are pushed toward the lower surface 62 of the housing by the body push parts 913 and 943 (see FIG. 2), which are provided at the respective slides.

When the first body 71 and the second body 74 are pushed by the body push parts 913 and 943, as shown in FIG. 9, the fastening body 75, which is supported by the first stopper 611, is separated from the first stopper 611, and is inserted into the receiving recess 54 of the holder.

When the fastening body 75 is separated from the first stopper 611, the free end of the first body 71 and the free end of the second body 74 are moved away from the introduction port 111 by restoring force of the first elastic member 77. Consequently, the first door body 161 closes the introduction port 111, and the second door body 163 closes the communication hole 115.

During the above procedure, the first sensing unit S1 and the second sensing unit S2 may transmit electrical signals to the controller (not shown), and the controller may determine whether the introduction port and the communication hole are closed.

Meanwhile, the fastening body 75, separated from the first stopper 611, the fastening body 75 is inserted into the receiving recess 54 of the holder, and the restoring force of the first elastic member 77 is set to be greater than force necessary for compressing the second elastic member. When the fastening body 75 is separated from the first stopper 611, therefore, the first elastic member 77 moves the holder H into the cabinet. In the present invention, therefore, it is possible to minimize force that the user is required to apply to the door 16 to close the introduction port 111 and the communication hole 115.

In addition, when the fastening body 75 is inserted into the receiving recess 54 of the holder, the protrusion 53 of the holder is located in the space between the fastening body 75 and the transfer part 95. When the door 16 to the introduction port 111 is closed, therefore, the position of the protrusion 53 may be fixed. That is, it is possible for the lock H and C according to the present invention to minimize the movement of the door 16 such that the introduction port 111 is opened when the door 16 to the introduction port 111 is closed (i.e. it is possible to prevent a gap from being formed between the closing surface and the communication hole).

In order to prevent the sealing part 173 from being damaged by the lock H and C according to the present invention, the range in which the transfer part 95, provided at the lock, is movable may be set such that the transfer part 95 cannot contact the sealing part 173.

As shown in FIG. 8, the holder H is located at the upper surface 165 of the second door body, and the transfer part 95 is configured to be moved from the introduction port 111 toward the communication hole 115 by the protrusion 53 of the holder when the introduction port 111 is closed. In the case in which the range in which the transfer part 95 is movable is set beyond the upper surface 165 of the second door body, therefore, the transfer part 95 may contact the sealing part 173 when the door 16 to the introduction port 111 is closed, with the result that the sealing part 173 may be damaged. Consequently, the range in which the transfer part 95 is movable may be set so as not to be beyond the upper surface 165 of the second door body (i.e. so as not to be beyond the space defined between the first door body and the closing surface of the second door body)

Meanwhile, when the user opens the door 16 to open the introduction port 111 in the state shown in FIG. 9, the fastening body 75 is moved toward the introduction port 111 by the protrusion 53 of the holder.

When the fastening body 75 is moved toward the introduction port 111, the first elastic member 77 is compressed toward the support unit 8 by the free end of the first body 71 and the free end of the second body 74, which are fixed to the fastening body 75, and the first slide 91 and the second slide 94 are moved toward the introduction port 111 by restoring force of the second elastic member 981 and 983.

When the first elastic member 77 is compressed toward the support unit 8 as the result of the fastening body 75 being moved toward the introduction port 111, the fastening body 75 is withdrawn from the receiving recess 54 of the holder and is then coupled to the first stopper 611. Consequently, the user may apply force necessary to compress the first elastic member 77 to the door in order to separate the holder H from the coupling unit C.

During the above procedure, the first slide 91 and the second slide 94 move toward the front surface 63 of the housing. As a result, the slide fastening part 927, provided at the actuation unit lock L, is inserted into the lock receiving recess 941 while being guided by the first incline 942, whereby the position of the second slide 94 is fixed.

In the lock having the above structure, a large amount of force is required to compress the second elastic member 981 and 983 when the introduction port 111 and the communication hole 115 are closed, and a large amount of force is required to compress the first elastic member 77 when the introduction port 111 is opened.

As previously described, force necessary to compress the first elastic member 77 is set to be greater than force necessary to compress the second elastic member 981 and 983. In the present invention, therefore, it is possible to provide a lock configured such that force to be applied to the door so as to open the introduction port 111 and the communication hole 115 is greater than force to be applied to the door so as to close the introduction port 111 and the communication hole 115.

Meanwhile, in order to prevent the fastening body 75 from interfering with the front surface 63 of the housing when the door is moved so as to open the introduction port, a through hole 631, through which the fastening body 75 is withdrawn out of the housing 6, may be further provided in the front surface 63 of the housing.

In the lock having the above structure, the fastening body 75 may be separated from the first stopper 611 when external force is applied to the housing 6 via the cabinet 1 in the state in which the introduction port 111 is open as the result of opening the door 16.

When the door 16 to the introduction port 111 is opened, the state in which the fastening body 75 is supported by the first stopper 611, as shown in FIG. 7, may be defined as a normal state, and the state in which the fastening body 75 is separated from the first stopper 611, as shown in FIG. 10, may be defined as an abnormal state.

In the lock H and C according to the present invention, a means capable of coupling the holder and the fastening unit 7 even when the fastening unit is in an abnormal state is needed. In the case in which the support unit 8 is configured to have the structure shown in FIG. 10, the support unit 8 may be a means for coupling the holder and the fastening unit 7 even when the fastening unit is in an abnormal state.

As shown in FIG. 10, the support unit 8 may include a support body 87 rotatably fixed to the housing, one end of the first elastic member 77 being fixed to the support body 87, and an extension part 89 extending from the support body 87 toward the first stopper 611.

In the case in which a first plate 81 and a second plate 83, which are spaced apart from each other to provide a space for receiving the first elastic member 77, may be provided in the housing 6, as shown in FIG. 4, the support body 87 may be located between the first plate 81 and the second plate 83.

The first plate 81 and the second plate 83 may define the movement path of the first elastic member 77, thereby preventing the first elastic member 77 from being dislocated or damaged.

In addition, the first plate 81 and the second plate 83 may also serve as a stopper (e.g. a second stopper) 811 for preventing the fastening body 75, separated from the first stopper 611, from moving to the rear of the housing 6. In this case, the second stopper 811 may support the fastening body 75 such that the fastening body 75, separated from the first stopper 611, is located below the extension part 89.

That is, the second stopper may include at least one selected from between one surface 811 of the first plate that faces the first stopper 611 and one surface 831 of the second plate that faces the first stopper 611. FIG. 4 shows an example in which the second stopper includes the front surface 811 of the first plate and the front surface 831 of the second plate.

The support body 87 may be provided with a shaft 871 protruding toward the respective plates 81 and 83 for defining a rotary shaft of the extension part 89. The first plate 81 and the second plate 83 may be provided with shaft support parts 85, in which the shaft is received.

Of course, the shaft support parts 85 may be provided at opposite surfaces of the support body 87 facing the respective plates, and the shaft 971 may protrude from the respective plates 81 and 83 toward the shaft support parts.

As shown in FIG. 10, the extension part 89 is a means for moving the fastening body 75 into a space P defined between the first stopper 611 and the support body 87 when the fastening body 75 is separated from the first stopper 611.

When the fastening body 75 is separated from the first stopper 611, the fastening body 75 is supported by the second stopper 811 and 831, with the result that the fastening body 75 is located below the extension part 89. When the user pushes the door 16 to close the introduction port 111 in this state, the protrusion 53 of the holder pushes the fastening body 75 toward the extension part 89.

The portion of the space defined by the fastening body 75 that the protrusion 53 of the holder contacts may be inclined such that the fastening body 75 is more easily pushed toward the extension part 89.

When the fastening body 75 is pushed toward the extension part 89, the extension part 89 is rotated about the shaft 891 away from the fastening body 75. As a result, the fastening body 75 is moved into the space P defined between the first stopper 611 and the support body 87 (i.e. the space defined between the first stopper and the second stopper).

When the fastening body 75 is moved into the space P defined between the first stopper 611 and the second stopper 811 and 831, the protrusion 53 of the holder moves between the transfer part 95 and the fastening body 75, with the result that the protrusion 53 is in the state shown in FIG. 9. In the present invention, therefore, it is possible to couple the holder H and the coupling unit C even when the fastening body 75 is separated from the first stopper 611.

Meanwhile, the first stopper 611 may be further provided with a location part 613 for supporting the free end of the extension part 89. The location part 613 is a means for preventing the extension part 89 from rotating toward the first lower surface through hole 621, which is provided in the lower surface of the housing.

A first hole 615 for supporting the upper end of the support body 87 may be further provided in the upper surface 61 of the housing as another means for preventing the extension part 89 from rotating toward the first lower surface through hole 621.

Furthermore, the housing may be further provided in the upper surface 61 thereof with a second hole 617 for preventing the free end of the extension part 89 from interfering with the upper surface of the housing when the extension part 89 is rotated.

Meanwhile, in the lock H and C having the above structure, when the fastening body 75 is separated from the first stopper 611, the fastening body 75 collides with the second stopper 811 and 831, whereby a sound signal is generated. Consequently, the user may confirm that the introduction port 111 has been closed by the door 16 based on the sound signal generated when the fastening body 75 collides with the second stopper 811 and 831.

The magnitude of the sound signal indicating that the door has been closed may be set as high as possible. In this case, however, the fastening body 75 or the second stopper 811 and 831 may be damaged. For this reason, the magnitude of the sound signal may be adjusted as appropriate.

The sound signal generated when the fastening body 75 collides with the second stopper 811 and 831 is set depending on restoring force of the first elastic member 77. In the lock according to the present invention, it is difficult to reduce the restoring force of the first elastic member 77. Consequently, the lock may include a separate shock absorbing means for reducing the magnitude of the sound signal generated when the fastening body 75 collides with the second stopper 811 and 831.

FIG. 9 shows an example in which a damper 84 is provided at the second stopper 811 and 831 or the support body 87 as a shock absorbing means.

As previously described, the fastening body 75 collides with the second stopper 811 and 831 when the fastening body 75 is separated from the first stopper 611. At this time, a sound signal is generated. Therefore, in the case in which a damper 84 for absorbing a portion of the impact generated when the fastening body 75 collides with the second stopper 811 and 831 is provided at the second stopper 811 and 831, it is possible to prevent damage to the fastening body or the second stopper and to prevent an excessive increase in the magnitude of the sound signal generated when the fastening body collides with the second stopper.

The material for the damper 84 is not particularly restricted as long as the damper can perform the above function. For example, the damper 84 may be made of rubber.

An embodiment shown in the upper part of FIG. 9 is characterized in that it is possible to prevent the fastening body 75 from colliding with the second stopper 811 and 831. The damper 84 according to this embodiment is provided at the support body 87. That is, the damper 84 according to this embodiment may be fixed to the lower part of the extension part 89 via a receiving part 82.

The fastening body 75, separated from the first stopper 611, is located below the extension part 89. In the case in which the support unit 8 is provided with a damper 84 for maintaining a predetermined distance between the fastening body and the second stopper 811 and 831, therefore, it is possible to prevent the fastening body 75 from colliding with the second stopper 811 and 831.

FIG. 11 is a view showing another embodiment of the lock according to the present invention. FIG. 12 is a view showing the state of the lock in the case in which the door to the introduction port is opened, FIG. 13 is a view showing the state of the lock in the case in which the door to the introduction port is closed normally, and FIG. 14 is a view showing the case in which the lock is operated even when the door to the introduction port is closed.

As previously described, when external force is applied to the housing 6 via the cabinet 1 even in the state in which the door 16 to the introduction port 111 is open, the fastening body 75 may be separated from the first stopper 611.

For example, when the user directly pushes the actuation unit lock L upward using his/her finger, the actuation unit 9 may reciprocate in the housing 6. When the user pushes the transfer part 95 away from the introduction port in this state, the actuation unit 9 moves away from the introduction port 111, and the fastening unit 7 is moved downward by the body push parts 913 and 943. As a result, the fastening body 75 may be separated from the first stopper 611.

When the door 16 to the introduction port 111 is opened, the state in which the fastening body 75 is supported by the first stopper 611, as shown in FIG. 7, may be defined as a normal state, and the state in which the fastening body 75 is separated from the first stopper 611, as shown in FIG. 10, may be defined as an abnormal state. In addition, the state in which the fastening body 75, separated from the first stopper 611, is coupled to the holder H when the door 16 to the introduction port 111 is closed may be defined as a door-closed state (see FIG. 9).

In the present invention, it is necessary to distinguish among the door-closed state, the normal state, and the abnormal state. The reason for this is that the positions of the actuation unit 9 and the fastening unit 7 are similar in the door-closed state (see FIG. 9) and the abnormal state (see FIG. 10), with the result that it may be determined that the door 16 to the introduction port is closed in both states, whereby operation may be performed in the state shown in FIG. 10.

In order to solve the above problem, the lock according to the present invention may include a holder H provided at the door 16, a housing 6 provided at the cabinet 1, a fastening unit 7 separably supported by a first stopper 611 provided at the housing 6, the fastening unit 7 being coupled to the holder H when separated from the first stopper 611 and being biased by a first elastic member 77 so as to be moved away from the introduction port 111, an actuation unit 9 configured to reciprocate in the housing 6, the actuation unit 9 being biased by a second elastic member 981 and 983 so as to be moved toward the introduction port 111, the actuation unit 9 contacting the holder H and moving away from the introduction port 111 to separate the fastening unit 7 from the first stopper 611 when the door 16 to the introduction port 111 is closed, and a sensing unit S1 and S2 for determining whether the fastening unit 7 has been separated from the first stopper 611 and coupled to the holder H.

The holder H includes a protrusion 53 extending from one end of the door 16. The protrusion 53 is coupled to the fastening unit 7. When the door 16 to the introduction port 111 is closed, the fastening unit 7 applies force to the protrusion 53 in the direction in which the door 16 is closed in order to fix the door 16. That is, when the door 16 to the introduction port is closed, the fastening unit 7 is separated from the first stopper 611 and is biased by the first elastic member 77 so as to be moved away from the introduction port 111 (i.e. so as to be moved in the rearward direction). However, the fastening unit 7 is caught by the protrusion 53, with the result that further movement of the fastening unit 7 is prevented. That is, the position of the fastening unit 7 is fixed.

Meanwhile, in the normal state (see FIG. 7), the fastening unit 7 is supported by the first stopper 611, provided at the housing 6, with the result that the position of the fastening unit 7 is fixed regardless of the first elastic member 77.

As previously described, the housing 6 is provided with a second stopper 811 and 831 for preventing the fastening body 75, separated from the first stopper 611, from moving to the rear of the housing 6.

The second stopper 811 and 831 is provided between the first body 71 and the second body 74. The second stopper 811 and 831 is spaced apart from the first stopper 611 such that the second stopper 811 and 831 is more distant from the introduction port 111 than the first stopper 611. The second stopper 811 and 831 may support the rear surface of the fastening body 75 to limit the movement of the fastening body 75. The second stopper 811 and 831 may include at least one selected from between one surface of the first plate 81 and one surface of the second plate 83 for rotatably fixing the support unit 8. FIG. 14 shows an example in which the second stopper includes the front surface 811 of the first plate and the front surface 831 of the second plate.

When the actuation unit lock L is unlocked, the actuation unit 9 can reciprocate between the front surface and the rear surface of the housing 6, and is pushed toward the introduction port (i.e. to the front surface of the housing) by the second elastic member 981 and 983. The locking and unlocking operation of the actuation unit lock L was previously described in detail, and therefore a further description thereof will be omitted.

When the door 16 to the introduction port 111 is closed, the door or the holder H, provided at the door, contacts the transfer part 95 to apply external force to the transfer part 95, and moves the actuation unit 9 away from the introduction port 111. In this case, the actuation unit 9 is moved away from the introduction port 111 (i.e. in the rearward direction), since the force applied from the door 16 to the transfer part 95 is larger than the elastic force of the second elastic member 981 and 983.

The body push parts 913 and 943 push the upper surface of the fastening unit 7 (specifically, the upper surface of the first body 71 or the second body 74) to move the fastening unit 7 downward. As a result, the fastening body 75 is separated from the first stopper 611. The fastening body 75 is coupled to the holder H of the door 16, or the movement of the fastening body 75 is limited by the second stopper 811 and 831.

The fastening body 75 is located at different positions depending on whether the door is in the normal state (see FIG. 7), the door is in the closed state (see FIG. 9), or the door is in the abnormal state (see FIG. 10).

When the door 16 is in the normal state, the fastening body 75 is supported by the front surface of the first stopper 611, with the result that the fastening body 75 is located close to the direction in which the door 16 is opened (i.e. the frontward direction) (see FIG. 12).

When the door 16 is in the closed state, the fastening body 75 is separated from the first stopper 611, and is supported by the holder H of the door 16. In the state in which the door 16 is closed, the holder H of the door 16 is spaced apart from the first stopper 611 such that the holder H is located closer to the direction in which the door 16 is closed (i.e. the rearward direction) than the first stopper 611, with the result that the holder H is located lower than the first stopper 611. Consequently, when the fastening body 75 is separated from the first stopper 611 while moving downward, the fastening body 75 is coupled to the holder H of the door 16, which is provided below the rear of the first stopper 611, with the result that the position of the fastening body 75 is fixed (see FIG. 13).

When the door 16 is in the abnormal state, the fastening body 75 is separated from the first stopper 611, and is supported by the second stopper 811 and 831. Since the door 16 is in the open state, the holder H of the door 16 is not located at the rear of the first stopper 611 (see FIG. 14).

The second stopper 811 and 831 is spaced apart from the first stopper 611 in the direction in which the door 16 is closed (i.e. in the rearward direction), and is located lower than the first stopper 611. Consequently, when the fastening body 75 is separated from the first stopper 611 while moving downward, the fastening body 75 is supported by the second stopper 811 and 831, which is provided below the rear of the first stopper 611, with the result that the position of the fastening body 75 is fixed.

In the case in which the fastening body 75 is separated from the first stopper 611 but is not coupled to the holder H, the second stopper 811 and 831 defines a movement limit point for limiting the movement of the fastening body 75 in the rearward direction.

In addition, the distance from the second stopper 811 and 831 to the first stopper 611 may be equal to or greater than the distance from the holder H to the first stopper 611 in the state in which the door 16 is closed. That is, in the state in which the door 16 is closed, the holder H may be provided on the same vertical line as the second stopper 811 and 831, and may be provided so as to be located closer to the door 16 (i.e. closer to the front side) than the second stopper 811 and 831. In other words, in the state in which the door 16 is closed, the holder H may be provided between the first stopper 611 and the second stopper 811 and 831.

The sensing unit S1 and S2 may determine whether the fastening unit 7 has been coupled to the holder H depending on the position of the actuation unit 9 when the actuation unit 9 moves away from the introduction port 111 (i.e. to the rear side).

The sensing unit S1 and S2 may include a first contact part S13 configured to contact the actuation unit 9 when the actuation unit 9 reciprocates in the housing 6 and a first switch S15 (see FIG. 4) for generating an electrical signal or interrupting the generation of an electrical signal when the first contact part S13 contacts the actuation unit 9. The electrical signal is transmitted from the first switch S15 to a controller 920 for controlling the operation of the home appliance.

Upon receiving the electrical signal from the first switch S15 or when the reception of the electrical signal is interrupted, the controller 920 may determine that the first contact point S13 has contacted the actuation unit 9. In the following description, the first switch S15 generates an electrical signal when the first contact point S13 contacts the actuation unit 9.

The controller 920 may perform control such that the home appliance is operated in response to a control command input by the user only when the electrical signal is received from the first switch S15. Alternatively, the controller 920 may perform control such that power is supplied to a load provided in the home appliance (i.e. a means for performing operation when energized) only when the electrical signal is received from the first switch S15.

When the fastening unit 7 is coupled to the first stopper 611, the first contact point S13 does not contact the actuation unit 9 (see FIG. 12). In addition, even when the fastening unit 7 is separated from the first stopper 611 but is not coupled to the holder H (i.e. in the abnormal state), the first contact point S13 does not contact the actuation unit 9 (see FIG. 14).

In this case, the first switch S15 generates no electrical signal. Consequently, the controller 920 may determine that the door 16 is not closed (i.e. that the current state is the normal state or the abnormal state), and may perform control such that the home appliance is not operated or such that the supply of power to the home appliance is interrupted.

Meanwhile, when the fastening unit 7 is separated from the first stopper 611 and is coupled to the holder H, the contact point S13 contacts the actuation unit 9 (see FIG. 13). Consequently, the first switch S15 may generate an electrical signal, and the controller 920 may determine that the door 16 is closed. As a result, the controller 920 may perform control such that the home appliance is operated or power is supplied to the home appliance (i.e. power is supplied to the load).

Hereinafter, the structures of the fastening unit 7, the actuation unit 9, and the sensing unit S1 and S2 will be described in detail.

The fastening unit 7 may include a fastening body 75 separably coupled to the first stopper 611, the fastening body being coupled to the holder H when separated from the first stopper 611, and a first body 71 extending from one end of the fastening body so as to be distant from the introduction port (i.e. in the rearward direction). The actuation unit 9 may include a transfer part 95 configured to contact the holder H so as to be moved away from the introduction port (i.e. in the rearward direction), a first slide 91 extending from one end of the transfer part 95, and a first body push part 913 provided at the first slide 91, the first body push part 913 being configured to contact the first body 71 depending on the position of the transfer part 95 to separate the fastening body 75 from the first stopper 611. The sensing unit S1 and S2 may include a first contact part S13 provided in the movement path of the first slide 91 so as to be selectively pushed by the first slide 91 and a first switch S15 for generating an electrical signal when the first contact part S13 is pushed by the first slide 91.

Meanwhile, the first contact part S13 is configured such that the end of the first contact part S13 is located in the movement path of the first slide 91. When the first slide 91 reciprocates, therefore, the end of the first contact part S13 may be pushed by the first slide 91 in the state of contacting the first slide 91.

The first slide 91 is provided with a first push release part 900 (see FIG. 12) for preventing the first contact part S13 from being pushed when the door is in the abnormal state. The first push release part 900 may be provided by concavely recessing the surface of the first slide 91 in the direction away from the first contact part S13. When the door is in the abnormal state (i.e. when the fastening body is supported by the second stopper), therefore, the first contact part S13 is inserted into the first push release part 900, with the result that the first contact part S13 is not pushed.

When the door is in the normal state (see FIG. 7), no external force from the door 16 is applied to the actuation unit 9, and thus the actuation unit 9 is not moved. Consequently, the first contact part S13 is not pushed by the first slide 91 (see FIG. 12).

When the fastening body 75 is separated from the first stopper 611 and is coupled to the holder H (i.e. when the door is closed), however, the first slide 91 pushes the first contact part S13 while moving away from the introduction port 111, and the first switch S15 generates an electrical signal (see FIG. 13).

Meanwhile, when the fastening body 75 is separated from the first stopper 611, but is not coupled to the holder H and is supported by the second stopper 811 and 831, with the result that the position of the fastening body 75 is fixed (i.e. in the abnormal state), the first contact part S13 is inserted into the first push release part 900 of the first slide 91, with the result that the first contact part S13 is not pushed, whereby the first switch S15 generates no electrical signal (see FIG. 14).

The reason for this is that the distance that the first slide 91 moves away from the introduction port 111 when the fastening body 75 is coupled to the holder H is greater than the distance that the first slide 91 moves away from the introduction port 111 when the fastening body 75 is supported by the second stopper 811 and 831.

In other words, the first slide 91 moves further away from the introduction port 111 (i.e. further in the rearward direction) in the abnormal state than when the door is closed. When the first slide 91 moves rearward as the door is closed, therefore, the first slide 91 continuously pushes the first contact part S13. When the first slide 91 abnormally moves rearward in the state in which the door is open, the first contact part S13 is not pushed, since the first contact part S13 is located in the first push release part 900.

In the above description, the sensing unit S1 and S2 includes the first contact part S13 and the first switch S15. Hereinafter, the case in which the sensing unit S1 and S2 further includes a second contact part S23 and a second switch S25 will be described.

As described above with reference to the embodiment shown in FIGS. 1 to 10, the fastening unit 7 may further include a second body 74 extending from the other end of the fastening body 75 so as to be distant from the introduction port 111. The actuation unit 9 may further include a second slide 94 extending from the other end of the transfer part 95 and a second body push part 943 provided at the second slide 94, the second body push part 943 being configured to contact the second body 74 depending on the position of the transfer part to separate the fastening body 75 from the first stopper 611. The sensing unit S1 and S2 may further include a second contact part S23 provided in the movement path of the second slide 94 so as to be selectively pushed by the second slide 94 and a second switch S25 for generating an electrical signal when the second contact part S23 is pushed by the second slide 94.

Even in this case, the second slide 94 may further include a concavely recessed second push release part 910 for preventing the second contact part S23 from being pushed by the second slide 94 in the case in which the fastening body 75 is stopped by the second stopper 811 and 831 (i.e. in the abnormal state). The end (i.e. the free end) of the second contact part S23 is located in the second push release part 910. Consequently, the second contact part S23 is not pushed by the second slide 94, with the result that the second switch S25 does not generate an electrical signal.

The controller 920 is connected to the second switch S25 to receive an electrical signal from the second switch S25. In this case, the controller may determine that the door has been normally closed.

Meanwhile, the controller 920 may be simultaneously connected to the first switch S15 and the second switch S25. When any one selected from between the first contact part S13 and the second contact part S23 is not pushed by either the first slide 91 or the second slide 94, the controller 920 may determine that the door is not closed. That is, when any one selected from between the first switch S15 and the second switch S25 does not generate an electrical signal, the controller 920 may determine that the door is not open.

Consequently, the controller may distinguish between the state in which the door is normally open and the state in which the door is abnormally open (i.e. the state in which only the actuation unit and the fastening unit are moved).

In other words, the controller 920 may determine that the door is closed only when both the first contact part S13 and the second contact part S23 are pushed. At this time, both the first switch S15 and the second switch S25 generate electrical signals, which are transmitted to the controller 920.

The controller 920 performs control such that the home appliance is operated in response to a command input by the user or a predetermined program. Upon determining that the door 16 is not closed, however, the controller 920 may perform control such that the operation of the home appliance is interrupted.

Upon determining that the door is not closed, on the other hand, the controller 920 may perform control such that the supply of power to the home appliance is interrupted. Consequently, it is possible to prevent the home appliance from being operated when the door is open (i.e. in the normal/abnormal state).

FIGS. 15 and 16 are views showing other examples of the lock sensing unit S3 provided in the present invention. The lock sensing unit S3 may include a third case S31 fixed to the housing 6, a third contact part S33 exposed to the outside of the third case, a third switch S35 provided in the third case for generating an electrical signal or interrupting the generation of an electrical signal in response to the operation of the third contact part, and a push part 37 configured to be operated by the lock body 921 for pushing the third contact part S33 to operate the third switch S35 when the lock body 921 moves in the direction in which the lock body 921 is separated from the second slide 94.

As shown in FIG. 15, the push part S37 may be formed in the shape of a bar configured to reciprocate between the lock body 921 and the third contact part S33. That is, the push part S37 may be formed in the shape of a bar configured to be moved toward the third contact part S33 by a second flange 921*c* provided at the lock body when the lock body 921 moves in the direction in which the lock body 921 is separated from the second slide.

The second flange 921*c* may be provided with a flange incline, and the push part S37 may be provided with a push part incline, which contacts the flange incline, such that the push part S37 can be easily moved by the second flange 921*c*.

When the third contact part S33 contacts the push part S37, the third contact part S33 may close the third switch S35 (i.e. a circuit including the third switch may be closed). When the contact between the third contact part S33 and the push part S37 is released, the third contact part S33 may open the third switch S35 (i.e. the circuit including the third switch may be opened).

The push part S37 shown in FIG. 16 is characterized in that the push part S37 includes a push part body S371 configured to contact the lock body 921 via the second flange 921*c*, a push protrusion S373 provided on the push part body S371, and a body spring S379 for pushing the push part body S371 toward the lock body 921.

The push protrusion S373 is configured to push the third contact part S33 when the lock body 921 is separated from the second slide 94. The body spring S379 is configured to provide elastic force necessary to maintain contact between the push part body S371 and the second flange 921*c*.

The push part S37 shown in FIG. 16 may further include a body guide S375 for defining the movement path of the push part body S371. One end of the body guide S375 may be fixed to the push part body S371, and the other end of the body guide S375 may extend through the housing 6. In this case, the body spring S379 may be located between a spring support part S377, which is provided at the body guide S375, and the housing 6.

The lock sensing unit S3 shown in any one of FIGS. 6, 15, and 16 may prevent a home appliance from being operated in the state in which the door 16 is open. The lock sensing unit S3 according to the present invention generates an electrical signal or interrupts the generation of an electrical signal only when the door 16 to the introduction port 11 is closed. In the case in which the controller (not shown) of the home appliance performs control such that the home appliance is operated only upon receiving an electrical signal from the lock sensing unit S3, therefore, it is possible to prevent the home appliance from being operated in the state in which the door is open.

As is apparent from the above description, the present invention has the effect of providing a lock configured such that force that a user is required to apply to a door in order to close an introduction port is smaller than force that the user is required to apply to the door in order to open the introduction port and a home appliance having the same.

In addition, the present invention has the effect of providing a lock including a holder and a fastening unit provided respectively at a cabinet having therein an introduction port and a door for opening and closing the introduction port and a home appliance having the same.

In addition, the present invention has the effect of providing a lock that is capable of preventing dislocation of a fastening unit, which is separably coupled to a holder, and a home appliance having the same.

In addition, the present invention has the effect of providing a lock that is capable of performing a function of fixing a door to a cabinet even when a fastening unit is dislocated and a home appliance having the same.

In addition, the present invention has the effect of providing a lock configured such that a holder and a fastening unit can be easily coupled to each other and such that the fastening unit is prevented from being separated from the holder when the holder and the fastening unit are coupled to each other and a home appliance having the same.

In addition, the present invention has the effect of providing a lock configured such that a holder and a fastening unit can be coupled to each other when the fastening unit moves to a position where the fastening unit is coupled to the holder even when a door to an introduction port is not closed and a home appliance having the same.

In addition, the present invention has the effect of providing a lock that is capable of generating a sound signal informing a user that the door to the introduction port is closed when the door to the introduction port is closed and a home appliance having the same.

In addition, the present invention has the effect of providing a lock that is capable of preventing an excessive increase in the magnitude of a sound signal generated when a door to an introduction port is closed and a home appliance having the same.

In addition, the present invention has the effect of providing a lock including a sensing unit for determining whether a fastening unit is coupled to a holder and whether a door to an introduction port is closed and a home appliance having the same.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A home appliance comprising:

a cabinet having an introduction port therein;

a tub provided in the cabinet;

a communication hole, through which an interior of the tub communicates with the introduction port;

a door comprising a first door body for opening and closing the introduction port, a second door body protruding from the first door body toward the tub, and a closing surface provided in the second door body for closing the communication hole when the first door body closes the introduction port;

a holder fixed to the door, the holder being located in a space defined between the closing surface and the first door body;

a housing provided at the cabinet;

a first stopper provided at the housing, the first stopper being located between the introduction port and the communication hole;

a fastening unit separably supported by the first stopper, the fastening unit being coupled to the holder when separated from the first stopper, the fastening unit comprising:

a fastening body separably coupled to the first stopper, the fastening body being coupled to the holder when separated from the first stopper; and a first body and a second body extending from opposite ends of the fastening body so as to be distant from the introduction port, when in place;

an actuation unit configured to reciprocate in the housing, the actuation unit being moved toward the communication hole in a state of contacting the holder when the first door body is moved in a direction in which the introduction port is closed, the actuation unit being configured to separate the fastening unit from the first stopper while the actuation unit is moved toward the communication hole, the actuation unit comprising:

a first slide and a second slide configured to reciprocate in the housing, the first slide and the second slide being spaced apart from each other so as to define a space for receiving the first body and the second body;

a transfer part for connecting the first slide and the second slide, the transfer part being configured to be moved by the holder; and a body push part provided on at least one selected from between the first slide and the second slide for contacting at least one selected from between the first body and the second body depending on a position of the transfer part to separate the fastening body from the first stopper; and a first elastic member for providing force necessary to move the fastening unit toward the communication hole when the fastening unit is separated from the first stopper;

a second elastic member for providing force necessary to move the actuation unit toward the introduction port; and an actuation unit lock separably coupled to at least one selected from between the first slide and the second slide, the actuation unit lock being configured to be separated from the actuation unit such that the actuation unit can reciprocate in the housing when in contact with the closing surface and configured to be coupled to the actuation unit such that a position of the actuation unit is fixed when not in contact with the closing surface, wherein the actuation unit lock is configured to release the coupling between the actuation unit and the housing before the holder contacts the transfer part.

2. The home appliance according to claim 1, wherein the actuation unit lock comprises:

a lock body separably coupled to the second slide; and a lock body extension part connected to the lock body through the housing such that a free end of the lock body extension part is exposed to an outside of the housing, the lock body extension part being configured to separate the lock body from the second slide when the free end contact an object.

3. The home appliance according to claim 2, wherein the lock body extension part is configured to be inclined away from the introduction port, when in place.

4. The home appliance according to claim 2, further comprising:

a slide fastening part protruding from the lock body toward the second slide;

a lock receiving recess provided in the second slide for providing a space for receiving the slide fastening part; and a first incline inclined downward from an inlet of the lock receiving recess toward a front surface of the second slide for defining a movement path of the slide fastening part.

5. The home appliance according to claim 2, further comprising:

a lock body guide fixed to the housing, the lock body being provided in a direction intersecting a movement direction of the second slide; and a guide insertion hole provided in the lock body for allowing a free end of the lock body guide to be inserted thereinto.

6. The home appliance according to claim 2, further comprising a sensing unit for determining whether the fastening body is separated from the first stopper.

7. The home appliance according to claim 6, wherein the sensing unit comprises:

a first contact part configured to contact the first slide when the first slide moves to a position where the fastening body is separated from the first stopper; and a first switch for generating an electrical signal or interrupting generation of an electrical signal when the first contact part contacts the first slide.

8. The home appliance according to claim 6, wherein the sensing unit comprises:

a first contact part configured to contact at least one selected from between the first body and the second body when the fastening body is separated from the first stopper; and a first switch for generating an electrical signal or interrupting generation of an electrical signal when the first contact part contacts the at least one selected from between the first body and the second body.

9. The home appliance according to claim 8, wherein the sensing unit comprises:

a second contact part configured to contact the second slide when the second slide moves to a position where the fastening body is separated from the first stopper; and a second switch for generating an electrical signal when the second contact part contacts the second slide.

10. The home appliance according to claim 9, further comprising:

a slide fastening part protruding from the lock body toward the second slide;

a lock receiving recess provided in the second slide for providing a space for receiving the slide fastening part;

a contact surface provided on the second slide for contacting the second contact part when the second slide moves to the position where the fastening body is separated from the first stopper; and a support surface located between the lock receiving recess and the contact surface for preventing the second contact part from being inserted into the lock receiving recess.

11. The home appliance according to claim 2, further comprising a lock sensing unit for determining whether the lock body is separated from the second slide.

12. The home appliance according to claim 1, wherein the first elastic member is configured to remain compressed when the fastening body is supported by the first stopper and to move the fastening body when the fastening body is separated from the first stopper, the second elastic member is configured to be compressed by at least one selected from between the first slide and the second slide while the actuation unit moves to a position at which the fastening body is separated from the first stopper, and force necessary to compress the first elastic member is set to be larger than force necessary to compress the second elastic member.

13. The home appliance according to claim 12, further comprising a second stopper located in the housing for defining a movement limit point of the fastening body, separated from the first stopper.

* * * * *